US008366249B2

(12) United States Patent
Umeda

(10) Patent No.: US 8,366,249 B2
(45) Date of Patent: Feb. 5, 2013

(54) LIQUID-DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 736 days.

(21) Appl. No.: 12/186,505

(22) Filed: Aug. 5, 2008

(65) Prior Publication Data

US 2009/0040254 A1 Feb. 12, 2009

(30) Foreign Application Priority Data

Aug. 8, 2007 (JP) ..... 2007-206499

(51) Int. Cl.
*B41J 2/175* (2006.01)

(52) U.S. Cl. ..... 347/85; 347/12

(58) Field of Classification Search ..... 347/85–87
See application file for complete search history.

(56) References Cited

U.S. PATENT DOCUMENTS

| | | | | |
|---|---|---|---|---|
| 5,040,002 | A | 8/1991 | Pollacek et al. | |
| 5,963,237 | A | 10/1999 | Ikkatai et al. | |
| 6,022,102 | A | 2/2000 | Ikkatai et al. | |
| 6,276,784 | B1 | 8/2001 | Ikkatai et al. | |
| 6,540,321 | B1 | 4/2003 | Hirano et al. | |
| 6,755,500 | B2 | 6/2004 | Hirano et al. | |
| 7,481,521 | B2 * | 1/2009 | Takemoto | 347/92 |
| 7,488,060 | B2 * | 2/2009 | Umeda | 347/85 |
| 7,828,422 | B2 * | 11/2010 | Kimura et al. | 347/86 |
| 2003/0007048 | A1 | 1/2003 | Otsuka et al. | |
| 2004/0145635 | A1 | 7/2004 | Ebisawa et al. | |
| 2006/0192820 | A1 | 8/2006 | Umeda | |
| 2008/0273046 | A1 | 11/2008 | Ishinaga et al. | |

FOREIGN PATENT DOCUMENTS

| | | | |
|---|---|---|---|
| JP | H04-220354 | A | 8/1992 |
| JP | H10-029318 | A | 2/1998 |
| JP | 2000334982 | A | 12/2000 |
| JP | 2002-240310 | A | 8/2002 |
| JP | 2002-370375 | A | 12/2002 |
| JP | 2003-053995 | A | 2/2003 |
| JP | 2004-017637 | A | 1/2004 |
| JP | 2004009450 | A | 1/2004 |
| JP | 2005-342961 | A | 12/2005 |

OTHER PUBLICATIONS

European Patent Office; European Search Report in Application No. 08014026.2 mailed Aug. 20, 2009.

Japan Patent Office, Notification of Reasons for Refusal for Japanese Patent Application No. 2007-206499, dispatched Dec. 6, 2011.

* cited by examiner

*Primary Examiner* — Ellen Kim
(74) *Attorney, Agent, or Firm* — Baker Botts L.L.P.

(57) ABSTRACT

A liquid-droplet ejecting apparatus, including: a plurality of liquid-droplet ejecting heads; a plurality of liquid storage chambers respectively communicating with the liquid-droplet ejecting heads and respectively storing liquids to be respectively supplied to the liquid-droplet ejecting heads; a plurality of liquid tanks respectively accommodating the liquids to be respectively supplied to the liquid storage chambers, the liquid tanks and the liquid storage chambers being configured to be connected to each other only when the liquids in the liquid tanks are respectively supplied to the liquid storage chambers; a common gas chamber communicating commonly with the liquid storage chambers via respective gas-permeable membranes; and a pressure control device configured to control a pressure in the common gas chamber such that, when the pressure becomes not higher than a threshold that is lower than an atmospheric pressure, the pressure becomes higher than the threshold.

3 Claims, 15 Drawing Sheets

LIQUID-DROPLET EJECTING APPARATUS

CROSS REFERENCE TO RELATED APPLICATION

The present application claims priority from Japanese Patent Application No. 2007-206499, which was filed on Aug. 8, 2007, the disclosure of which is herein incorporated by reference to its entirety.

BACKGROUND OF THE INVENTION

1. Field of the Invention

The present invention relates to a liquid-droplet ejecting apparatus.

2. Discussion of Related Art

As a liquid-droplet ejecting apparatus for ejecting liquid droplets, there is known an ink-jet printer which records images based on image data by ejecting liquid droplets from a liquid-droplet ejecting head toward a recording medium.

Such an ink-jet printer includes: an ink cartridge mounted on a body of the printer; a sub tank to which an ink stored in the ink cartridge is supplied; and an ink-jet head which prints images by ejecting the ink stored in the sub tank from a plurality of nozzles.

The ink cartridge and the sub tank are not held in constant communication with each other, but are brought into communication with each other by a device for connecting and disconnecting the sub tank and the ink cartridge to and from each other, only when the sub tank is replenished with the ink stored in the ink cartridge, In the arrangement described above, the sub tank and the ink cartridge are disconnected from each other when printing is performed, so that images are printed with the ink in the sub tank. The sub tank and the ink cartridge are connected to each other when the amount of the ink in the sub tank becomes small, so that the sub tank is replenished with the ink in the ink cartridge.

The above-described ink-jet printer needs to be configured such that the ink stored in the sub tank does not leak through the nozzles of the ink-jet head. Because the ink in the sub tank tends to flow toward the nozzles according to gravity in particular when the sub tank is disposed above the ink-jet head, some measures need to be taken to prevent ink leakage from the nozzles.

There have been proposed some techniques to prevent the ink leakage. As one example of the techniques, an ink absorbing member is disposed in the sub tank for preventing the ink leakage from the nozzles owing to the absorbing power of the ink absorbing member.

As another example of the techniques, a space in the sub tank in which the ink is not present is always subjected to a negative pressure for thereby preventing the ink leakage from the nozzles. More specifically, the space in the sub tank is evacuated to place the space under the negative pressure, and subsequently the space is hermetically closed, whereby the space is kept under the negative pressure.

However, the volume of the hermetically closed space increases in accordance with consumption of the ink in the sub tank. Accordingly, the negative pressure in the hermetically closed space increases in accordance with the ink consumption, so that the characteristics of ink ejection from the nozzles fluctuates, causing a risk of unstable image quality.

In view of the above, Patent Document 1 discloses an ink-jet recording apparatus in which the sub tank and the ink cartridge are connected only when the sub tank is replenished with ink. The disclosed apparatus is configured such that the negative pressure in the sub tank does not increase. In the following description, the negative pressure means a pressure lower than an atmospheric pressure, and the increase of the negative pressure means that the pressure which is lower than the atmospheric pressure further decreases or reduces.

The sub tank of the disclosed ink-jet recording apparatus has a communication portion for communication with the atmosphere formed at an upper portion of a casing of the sub tank, and an orifice is formed so as to extend in a downward direction from the communication portion to the vicinity of a bottom surface of the sub tank. At a lower end of the orifice, there is formed an opening through which the interior of the sub tank communicates with the atmosphere. Since the opening is disposed in the vicinity of the bottom surface of the sub tank, the opening is generally located below the surface of the ink stored in the sub tank irrespective of the height level of the ink surface.

In the thus constructed sub tank, there is formed, at the opening, an interface of the ink and the atmosphere. The surface tension of the interface and the atmospheric pressure are balanced, thereby preventing entry of the air into the sub tank through the opening. Therefore, the space in the sub tank can be kept in the hermetically closed state. Further, the negative pressure of the space in the sub tank can be maintained by hermetically closing the space after the space has been evacuated to place the space under the negative pressure for the purpose of preventing the ink leakage.

In the arrangement described above, when the ink is consumed by a recording operation, the volume of the hermetically closed space in the sub tank is increased. According to the Boyle's law showing relationship that a product of a volume and a pressure of a gas is always constant, the pressure in the space is lowered in inverse proportion to the increase of the volume of the space, so that the negative pressure in the sub tank is increased. Due to the increase of the negative pressure, the opening is subjected to a force by which the air is drawn into the sub tank.

When the negative pressure continues to increase and finally exceeds a prescribed value (threshold), the force of drawing the air into the sub tank becomes larger than the surface tension at the opening, so that the balance between the pressure of the atmosphere and the surface tension at the opening is upset, resulting in introduction of the air into the sub tank through the opening. Consequently, the volume of the gas in the sub tank is increased, whereby the negative pressure in the sub tank is decreased according to the above-indicated Boyles law. Thus, it is possible to suppress the increase of the negative pressure in the sub tank.

Patent Document 1 JP-A-2004-9450

SUMMARY OF THE INVENTION

Where the arrangement disclosed in the above-indicated Patent Document 1 is employed in an apparatus configured to print color images, the apparatus may have a plurality of sub tanks in which are respectively stored a black ink, a cyan ink, a yellow ink, and a magenta ink.

In the thus constructed apparatus, it is considered that the ink ejection characteristic which is influenced by the diameter size of each of dots that form the image to be recorded fluctuates due to a change of the negative pressure in the sub tank, in addition to factors determined at the design stage, such as the flow resistance in the liquid-droplet ejecting head.

Accordingly, the recording operation is performed such that the change of the negative pressure in the sub tank falls within a predetermined range. Therefore, the change of the dot diameter size can fall within a predetermined range, whereby the image with high quality can be formed.

In color printing, the dot diameter sizes for the respective colors are determined to have a prescribed proportional relationship for forming the image with high quality. The dots having the diameter sizes determined for the respective colors are combined to form the image.

Accordingly, even if the dot diameter sizes for the respective colors fall within the respective predetermined ranges, the quality of the image to be recorded deteriorates where the dot diameter size for any of the colors gets out of the prescribed proportion. In view of this, it is necessary to keep balance among the dot diameter sizes for the respective colors such that the dot diameter sizes for the respective colors maintain the prescribed proportional relationship, to prevent the deterioration of the image quality. To this end, it is required to keep good balance among the magnitudes of the negative pressures in the respective sub tanks.

However, the amounts of ink consumed in the respective sub tanks vary from sub tank to sub tank depending upon the image to be printed. It is accordingly impossible to continuously consume the inks of the plurality of colors while keeping good balance among the ink amounts stored in the respective sub tanks. In other words, the balance among the volumes of the spaces in the respective sub tanks is upset, whereby the balance among the dot diameter sizes for the respective colors is also upset, resulting in the deterioration of the quality of the image to be recorded.

It is therefore an object of the invention to provide a liquid-droplet ejecting apparatus capable of keeping good balance among ejection characteristics of droplets to be ejected from a plurality of nozzle groups respectively communicating with a plurality of liquid storage chambers.

The above-indicated object may be attained according to a principle of the invention, which provides a liquid-droplet ejecting apparatus, comprising: a plurality of liquid-droplet ejecting heads each including a nozzle from which liquid droplets are ejected; a plurality of liquid storage chambers which respectively communicate with the plurality of liquid-droplet ejecting heads and which respectively store liquids to be supplied respectively to the plurality of liquid-droplet ejecting heads; a plurality of liquid tanks which respectively accommodate the liquids to be supplied respectively to the plurality of liquid storage chambers; a first communication-state changing device which is operable to place the plurality of liquid storage chamber and the plurality of liquid tanks in a mutually communicating state, in a supply mode in which the liquids respectively stored in the plurality of liquid tanks are respectively supplied to the plurality of liquid storage chambers, and which is operable to place the plurality of liquid storage chambers and the plurality of liquid tanks in a non-communicating state, in an ejection mode in which the liquids respectively stored in the plurality of liquid storage chambers are ejected from the respective liquid-droplet ejecting heads; a common gas chamber which communicates commonly with the plurality of liquid storage chambers via respective gas-permeable membranes each of which is configured to be gas-permeable and liquid-impermeable, the common gas chamber being configured to be hermetically closed with respect to an exterior thereof at least in the ejection mode; a pump which introduces and discharges a gas into and from the common gas chamber; a controller configured to control the first communication-state changing device to operate for placing the plurality of liquid storage chambers and the plurality of liquid tanks in the mutually communicating state and to control the pump to operate for discharging the gas from the common gas chamber while the mutually communicating state is maintained, in the supply mode; and a pressure control device configured to control a pressure in the common gas chamber such that, when the pressure becomes not higher than a threshold that is lower than an atmospheric pressure, the pressure becomes higher than the threshold.

In the liquid-droplet ejecting apparatus constructed as described above, the common gas chamber communicates commonly with the plurality of liquid storage chambers via the respective gas-permeable membranes, whereby the gas can flow between the common gas chamber and the liquid storage chambers. The common gas chamber is configured to be hermetically closed with respect to the exterior thereof at least in the ejection mode, so that the common gas chamber functions as a hermetically closed space. Accordingly, the common gas chamber and the plurality of liquid storage chambers communicating therewith provide one integral hermetically closed space. In the ejection mode, the liquid in each of the liquid storage chambers is consumed, so that there is formed, in each of the plurality of liquid storage chamber, a hermetically closed space in which no liquid is present.

In the state described above, when the liquid in each liquid storage chamber is ejected from the nozzle, the hermetically closed space in the liquid storage chamber communicating with the nozzle is enlarged. Because the closed space in the liquid storage chamber is a part of the above-indicated one integral hermetically closed space, it is possible to consider that the one integral hermetically closed space is enlarged. Accordingly, because the volume of the one integral closed space is increased, the pressure in the one integral closed space is decreased. Therefore, it is possible to consider that the pressure in each of the plurality of liquid storage chambers that belong to the one integral closed space is similarly decreased.

Thus, the pressure decreases in the plurality of liquid storage chambers after ink ejection can be regarded as the pressure decrease in the one integral hermetically closed space that is constituted by the common gas chamber and the closed spaces of the respective liquid storage chambers. Accordingly, the pressure decreases in the plurality of liquid storage chambers can be made equal to each other, thereby maintaining the balance of the magnitude of the pressure among the plurality of liquid storage chambers. Thus, it is possible to maintain the balance among the ejection characteristics of droplets to be ejected from a plurality of nozzle groups respectively communicating with the plurality of liquid storage chambers.

BRIEF DESCRIPTION OF THE DRAWINGS

The above and other objects, features, advantages and technical and industrial significance of the invention will be better understood by reading a following detailed description of preferred embodiments of the invention, when considered in connection with the accompanying drawings, in which.

DETAILED DESCRIPTION OF THE PREFERRED EMBODIMENTS

There will be first explained an ink-jet printer according to a first embodiment, to which the present invention is applied. The ink-jet printer as a liquid-droplet ejecting apparatus is configured to record an image by ejecting liquid droplets from a liquid-droplet ejecting head toward a recording medium.

The ink-jet printer indicated at 1 in FIG. 1 will be explained with reference to the plan view of FIG. 1.

Figure 1:
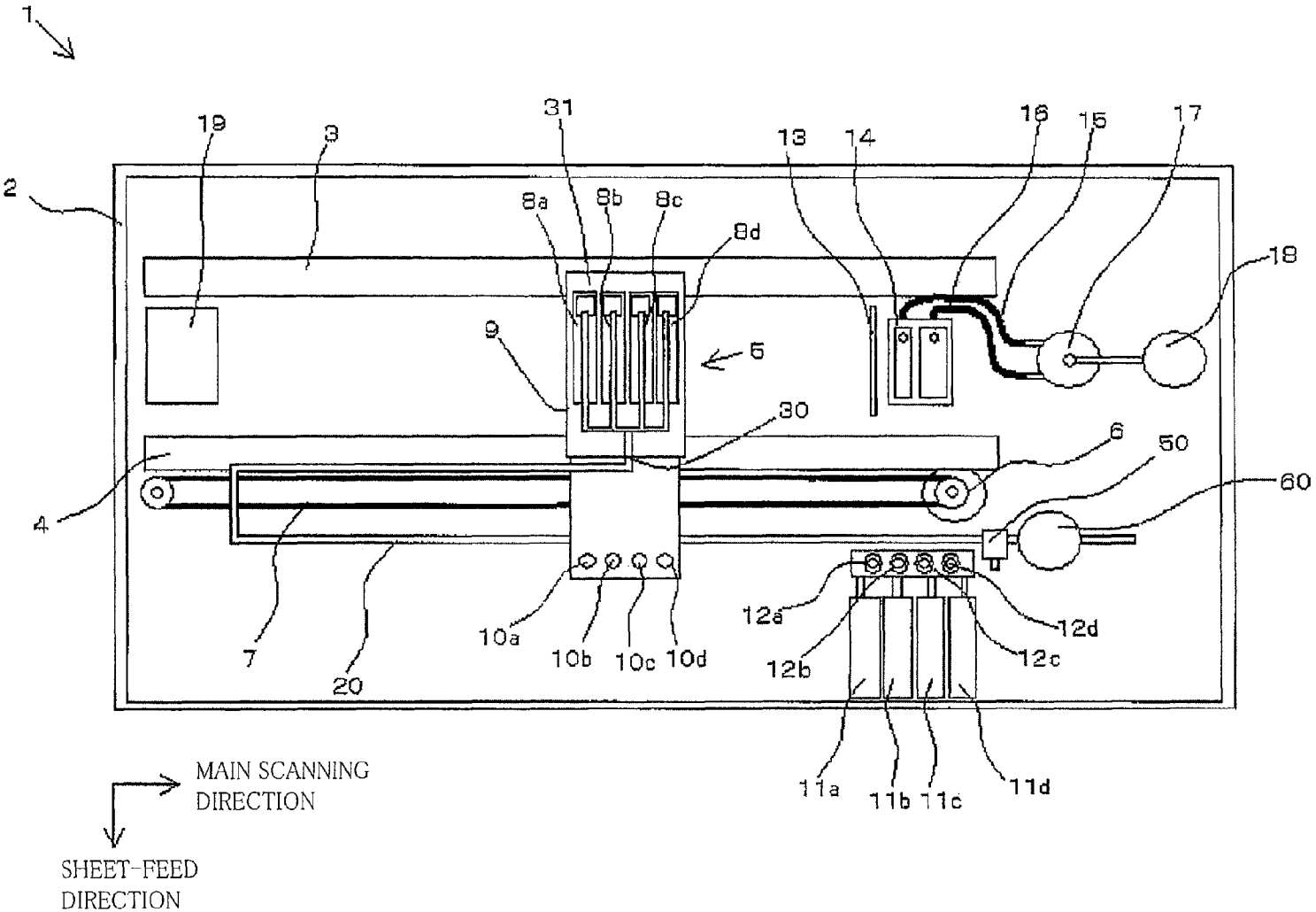
FIG. 1 is a plan view schematically showing an ink-jet printer according to a first embodiment of the invention.

As shown in FIG. 1, the ink-jet printer 1 has, in its casing 2, guide shafts 3, 4 extending in a main scanning direction indicated by an arrow in FIG. 1. The guide shafts 3, 4 are for guiding a carriage 5 such that the carriage 5 moves in the main scanning direction. There is disposed, in the casing 2, a carriage drive motor 6 having a drive shaft around which an endless belt is wound. The endless belt 7 is connected to the carriage 5, whereby the endless belt 7 travels in a direction corresponding to a rotational direction of the drive shaft of the carriage motor 6 when the drive shaft rotates, so that the carriage 5 is reciprocated in the main scanning direction. The carriage drive motor 6, the endless belt 7, and the guide shafts 3, 4 cooperate with each other to constitute a carriage moving device for moving the carriage 5.

Figure 3:
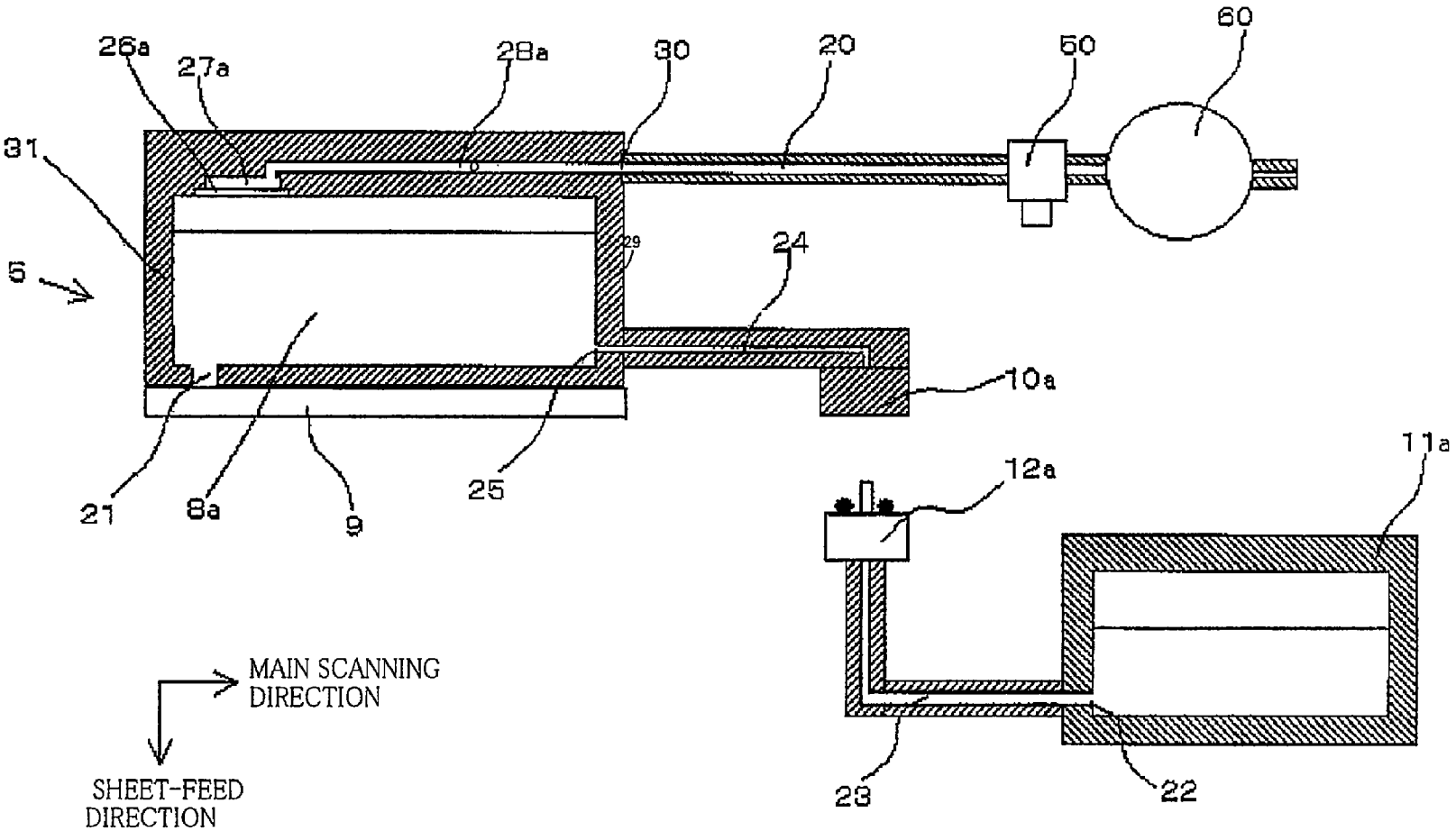
FIG. 3 is a cross-sectional view showing one of the sub tanks, one of the ink cartridges, the pressure control valve, the pump, and a part of the joint portions.

On the carriage 5, a box-like body 31 is mounted in which sub tanks 8*a*-8*d* each as a liquid storage chamber are juxtaposed to each other in the main scanning direction. The sub tanks 8*a*-8*d* store a black ink, a yellow ink, a cyan ink, and a magenta ink, respectively. In each of the sub tanks 8*a*-8*d*, a communication hole 21 is formed at a lower portion of an inner surface of each sub tank, i.e., at a bottom portion, as shown in FIG. 3. Each of the sub tanks 8*a*-8*d* is held in communication with an ink-jet head unit 9 via an ink passage communicating with the corresponding communication hole 21. The ink-jet head unit 9 (hereinafter referred to as "head unit 9" where appropriate) is located below the box-like body 31 and is mounted on the carriage 5. The head unit 9 includes a plurality of ink-jet heads each as a liquid-droplet ejecting head. Each ink-jet head has a plurality of nozzles (not shown) through which ink droplets are ejected toward a recording sheet (not shown) that is fed below the carriage 5 by a sheet-feed mechanism (not shown). In FIG. 1, the recording sheet is located behind the carriage 5, as seen in a direction perpendicular to the sheet plane of FIG. 1. The plurality of ink-jet heads of the head unit 9 include respective ink passages connecting the corresponding sub tanks 8*a*-8*d* and the corresponding nozzles. Further, on the carriage 5, there are provided joint portions 10*a*-10*d* connected to the corresponding sub tanks 8*a*-8*d*.

In the casing 2, four ink cartridges 11*a*-11*d* each as a liquid tank are detachably disposed. The ink cartridges 11*a*-11*d* respectively accommodate the black ink, the yellow ink, the cyan ink, and the magenta ink to be supplied to the corresponding sub tanks 8*a*-8*d*. When the ink cartridges 11*a*-11*d* are mounted on the casing 2, the ink cartridges 11*a*-11*d* are brought into communication with corresponding joint portions 12*a*-12*d*. The joint portions 12*a*-12*d* are configured to be joined to the corresponding joint portions 10*a*-10*d* described above, for permitting communication between the ink cartridges 11-11*d* and the sub tanks 8*a*-8*d*. More specifically, when the carriage 5 is moved to a certain position, the joint portions 10*a*-10*d* and the joint portions 12*a*-12*d* are joined with each other for permitting communication between the ink cartridges 11-11*d* and the sub tanks 8*a*-8*d*. The position of the carriage 5 at which the joint portions 10*a*-10*d* and the joint portions 12*a*-12*d* are joined is referred to as a liquid-supply position.

In the casing 2, a wiper 13 is disposed at one end in a direction in which the carriage 5 is moved (i.e., at a right-side end in FIG. 1). The wiper 13 is configured to be vertically moved by a wiper raising-and-lowering mechanism (not shown). More specifically, the wiper 13 is vertically raised by the mechanism when the carriage 5 is moved to a position where the carriage 5 and the wiper 13 overlap as seen in the direction perpendicular to the sheet plane of FIG. 1, whereby the wiper 13 is brought into contact with a lower surface of the ink-jet head unit 9 in which the nozzles are formed (hereinafter referred to as "nozzle surface"). With the wiper 13 contacting the nozzle surface, the carriage 5 is moved in the main scanning direction toward the right-side end in FIG. 1, so that the ink adhering to the nozzle surface is wiped away by the wiper 13.

On the right side of the wiper 13 in FIG. 1, a cap 14 used for a purging operation is disposed. The cap 14 has a concave shape opening upward and is supported by a cap raising-and-lowering mechanism (not shown) for vertically moving the cap 14. When the carriage 5 is moved to a position where the carriage 5 and the cap 14 overlap as seen in the direction perpendicular to the sheet plane of FIG. 1, the cap 14 is raised such that the peripheral portion of the opening of the cap 14 is brought into contact with the nozzle surface of the head unit 9. The peripheral portion of the opening of the cap 14 is provided with an elastic member for ensuring high adhesion with respect to the nozzle surface. The inside of the cap 14 is divided into two portions (i.e., two cap portions) one of which is used for performing a purging operation on the nozzles for the black ink and the other of which is used for performing a purging operation on the nozzles of the color inks. The two cap portions respectively have, at bottom portions thereof, through-holes connected to cap tubes 15, 16, respectively, which are in turn connected to a purging pump 18 via a switching unit. After the cap 14 and the nozzle surface contact each other, the nozzles for the black ink or the nozzles for the color inks are selected by the switching unit 17, and one of the cap tubes 15, 16 that is connected to a corresponding one of the two cap portions for the selected nozzles is placed in its open state for permitting communication between the inside of the cap portion and the purging pump 18. Subsequently, the purging pump 18 is driven, whereby the inside of the cap portion communicating with the pump 18 can be placed under a negative pressure. Thus, the purging operation on the nozzles for the black ink and the purging operation on the nozzles for the color inks can be performed in respective different sections of the inner space of the cap 14. It is noted that the cap 14 is allowed to come into close contact with the nozzle surface at the above-indicated liquid-supply position of the carriage 5.

In the casing 2, a flushed-ink receiving portion 19 is disposed at a left-side end in FIG. 1. When a flushing operation is performed for the nozzles of the head unit 9, the ink ejected from the nozzles is received by the flushed-ink receiving portion 19.

A region in the casing 2 existing between the wiper 13 and the flushed-ink receiving portion 19 in the main scanning direction is a prescribed region in which printing is performed on the recording sheet fed by the sheet-feed mechanism, by ejecting ink droplets from the nozzles of the head unit 9 while the carriage 5 is reciprocatingly moved in the main scanning direction.

In the casing 2, a pump 60 is disposed so as to be fixed to the casing 2. The pump 60 is configured to discharge and introduce a gas from and into the sub tanks 8*a*-8*d*. Further, a tube 20 is provided between the pump 60 and the sub tanks 8*a*-8*d* for communication therebetween. In the box-like body 31, there is formed an opening 30 which is in communication with the sub tanks 8*a*-8*d*. The tube 20 is connected at its one end to the opening 30 of the box-like body 31 and at the other end thereof to the pump 60. The tube 20 has a length enough to maintain the connection between the pump 60 and the opening 30 within a maximum movable range of the carriage 5 in which the carriage 5 is reciprocatingly moved.

In the vicinity of the other end of the tube 20, a communication portion is provided for permitting communication between the inner space of the tube 20 and an exterior thereof. In the communication portion, there is provided a pressure control valve 50 configured to open an close the communication portion depending upon the magnitude of the pressure in a space including the inner space of the tube 20 and spaces in the respective sub tanks 8*a*-8*d*. The pressure control valve 50 is disposed in the casing 2 so as to be fixed thereto.

In the present embodiment, an intra-body common chamber is constituted by recesses 27*a*-27*d* which are connected to the respective sub tanks 8*a*-8*d* via respective gas-permeable membranes 26*a*-26*d*, gas passages 28*a*-28*d* which extend from the respective recesses 27*a*-27*d*, and a common gas passage 29 which communicates commonly with the gas passages 28*a*-28*d*. Further, a common gas chamber is constituted by the intra-body common chamber and the inner space of the tube 20 connected to the opening 30 which communicates with the common gas passage 29. The pressure in the common gas chamber is lower than the atmospheric pressure, namely, the common gas chamber is kept under a negative pressure. The above-indicated pressure control valve 50 corresponds to a pressure control device which controls the pressure in the common gas chamber. In the arrangement described above, the inner space of the tube 20 which is provided for permitting communication between the intra-body common chamber and the pump 60 functions as a part of the common gas chamber, whereby the volume of the common gas chamber can be substantially increased by utilizing the inner space of the tube 20. Thus, it is possible to avoid an increase of the size of the ink-jet printer 1.

Next, the sub tanks 8*a*-8*d*, the ink cartridges 11*a*-11*d*, the pressure control valve 50, and the pump 60 will be explained in detail.

Figure 2:
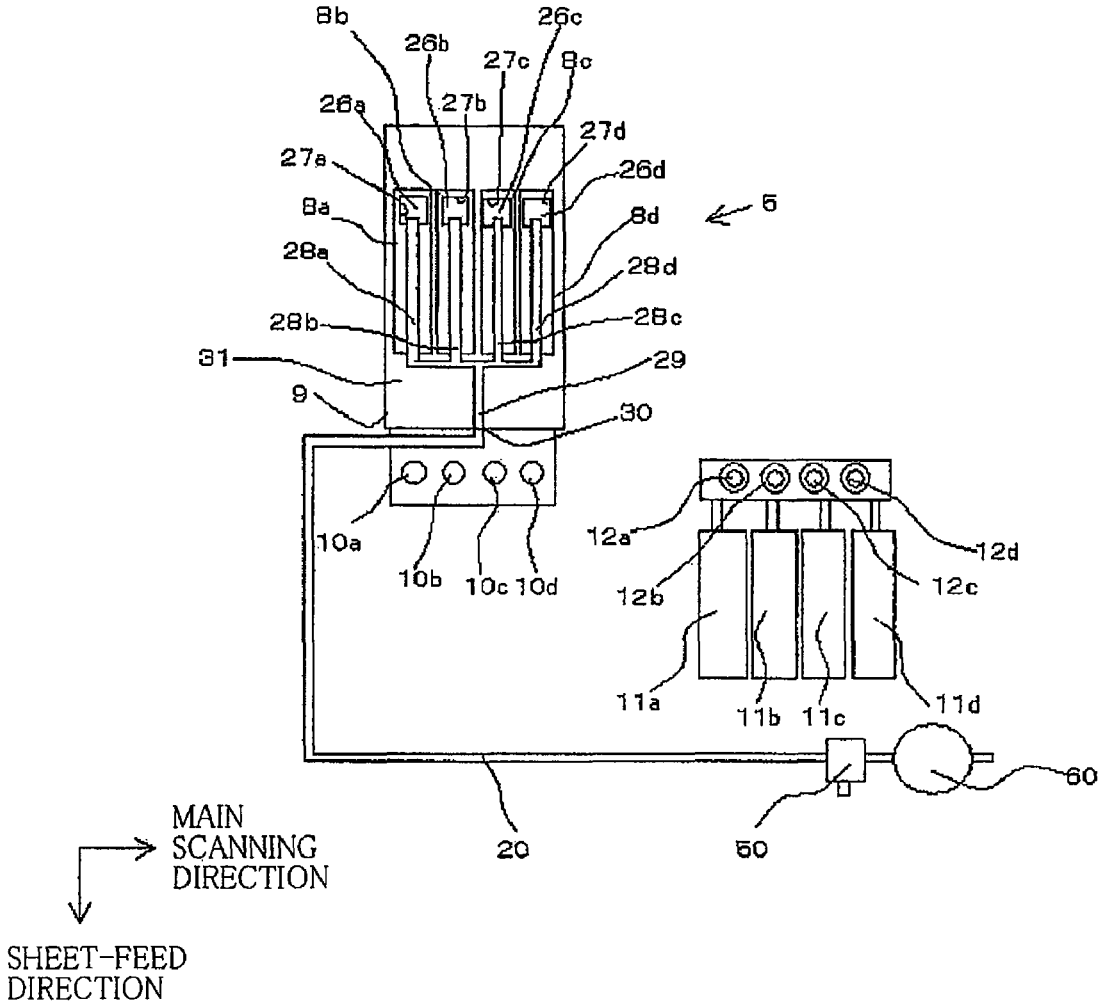
FIG. 2 is a plan view showing sub tanks, ink cartridges, a pressure control valve, a pump, and joint portions.

FIG. 2 is a schematic plan view showing the sub tanks 8*a*-8*d*, the ink cartridges 11*a*-11*d*, the pressure control valve 50, the pump 60, and the joint portions 10*a*-10*d* and 12*a*-12*d*. FIG. 3 is a schematic cross sectional view showing the sub tank 8*a*, the ink cartridge 11*a*, the pressure control valve 50, the pump 60, and the joint portions 10*a* and 12*a*. With reference to FIG. 3, the explanation will be made only with respect to the sub tank 8*a* and the ink cartridge 11*a* since the sub tanks 8*a*-8*d* are identical with each other in structure and the ink cartridges 11*a*-11*d* are identical with each other in structure. Similarly, since the joint portions 10*a*-10*d* are identical with each other in structure and the joint portions 12*a*-12*d* are identical with each other in structure, the explanation will be made only with respect to the joint portion 10*a* and the joint portion 12*a* with reference to FIG. 3.

As shown in FIG. 2, the opening 30 connected to the one end of the tube 20 is a part of the common gas passage 29 communicating with the sub tanks 8*a*-8*d* and functions as one end of the common gas passage 29. The other end of the common gas passage 29 is branched into four portions which communicate with the respective gas passages 28*a*-28*d*. The common gas passage 29 communicates with the recesses 27*a*-27*d* via the respective gas passages 28*a*-28*d* and further communicates with the sub tanks 8*a*-8*d* via the respective gas-permeable membranes 26*a*-26*d* disposed in the respective recesses 27*a*-27*d*.

As shown in FIG. 3, the sub tank 8*a* has a generally rectangular shape in cross section and stores ink supplied from the ink cartridge 11*a*. The sub tank 8*a* has the communication hole 21 formed in the bottom surface thereof. The communication hole 21 communicates with the ink passage (not shown) formed in the head unit 9. Accordingly, the ink in the sub tank 8*a* flows from the communication hole 21, via the ink passage, into pressure chambers (not shown) formed in the head unit 9. A pressure is applied to the ink in the pressure chambers by a piezoelectric actuator (not shown), whereby the ink is ejected from the pressure chambers through the corresponding nozzles.

The ink cartridge 11*a* has a generally rectangular shape in cross section, and the volume thereof is larger than that of the sub tank 8*a*. The ink cartridge 11*a* accommodates the ink to be supplied to the sub tank 8*a* and is formed with an opening 22 which communicates with an ink replenish passage 23 connected to the joint portion 12*a*.

The joint portion 12*a* is configured to be connectable to the joint portion 10*a*. The joint portion 10*a* is connected to an ink replenish passage 24 that communicates with an opening 25 formed in the sub tank 8*a*. Thus, in supplying the ink from the ink cartridge 11*a* to the sub tank 8*a*, the joint portion 10*a* and the joint portion 12*a* are connected to each other. In this state, the ink in the ink cartridge 11*a* initially flows toward the joint portion 12*a* through the opening 22 and the ink replenish passage 23, then flows, via the joint portion 10*a*, into the replenish passage 24 which is in fluid communication with the ink replenish passage 23, and finally flows into the sub tank 8*a* through the opening 25 connected to the ink replenish passage 24.

The above-described communication hole 21, ink replenish passage 24, and opening 25 are provided in the respective sub tanks 8*a*-8*d*. Similarly, the above-described opening 25 and ink replenish passage 23 are provided in the respective ink cartridges 11*a*-11*d*.

The recess 27*a* is formed such that a portion of the box-like body 31 that defines an upper surface of the sub tank 8*a* is partially recessed. The gas-permeable membrane 26*a* is fitted in and bonded to an open end of the recess 27*a*. The gas-permeable membrane 26*a* is configured to pass a gas therethrough but to inhibit the ink and the solid matters from passing therethrough. For instance, a porous fluororesin membrane is used as the gas-permeable membrane 26*a*. The recess 27*a* is connected at its upper end to the gas passage 28*a* which is connected to the common gas passage 29 and communicates, through the common gas passage 29, with the opening 30 formed in the box-like body 31. To the opening 30, the above-indicted one end of the tube 20 is connected, whereby the common gas passage 29 and the inner space of the tube 20 are held in communication with each other. The above-indicated other end of the tube 20 is connected to the pump 60. Further, in the vicinity of the other end of the tube 20, the communication portion is provided for communication between the inner space of the tube 20 and the exterior thereof. The pressure control valve 50 for opening and closing the communication portion is disposed in the casing 2 so as to be fixed thereto.

The pressure control valve 50 will be explained referring to FIG. 4. The pressure control valve 50 has a casing 51 in which are formed a valve accommodating chamber 52, a communication hole 53 for communication between the valve accommodating chamber 52 and an exterior thereof, and a communication hole 54 for communication between the valve accommodating chamber 52 and the inner space of the tube 20. The communication hole 54 is connected to the communication portion of the tube 20. Between the valve accommodating chamber 52 and the communication hole 53, there are provided a valve-member insertion hole 55 and a stopper accommodating chamber 56 each of which has a substantially cylindrical shape and which have respective diameters smaller than the diameter of the valve accommodating chamber 52.

Figure 4:
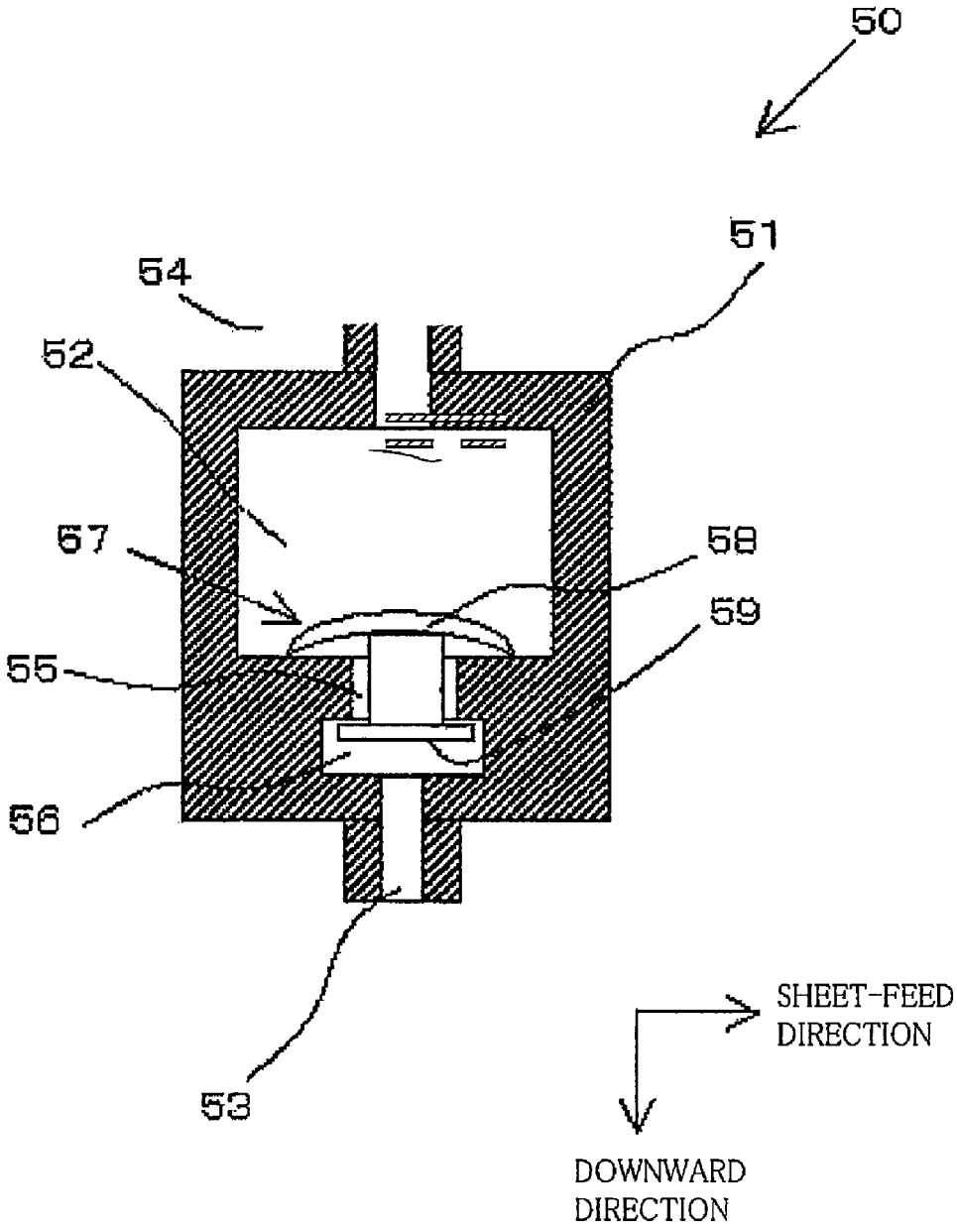
FIG. 4 is a cross-sectional view of the pressure control valve.

As shown in FIG. 4, there is inserted, in the valve-member insertion hole 55, a valve member 57 that includes: a cylindrical portion whose diameter is smaller than the valve-member insertion hole 55; and a valve portion 58 and a stopper portion 59 which are provided at one and the other of opposite ends of the cylindrical portion, respectively, and which have respective diameters larger than the valve-member insertion hole 55. The valve portion 58 which is formed of an elastic material has a concave shape and is disposed in the valve accommodating chamber 52 such that its open end faces downward, whereby the valve-member insertion hole 55 is covered by the valve portion 58. The stopper portion 59 is in contact with an inner wall surface of the stopper accommodating chamber 56. The stopper portion 59 is formed, in a region thereof, with a through-hole through which a gas flows between the valve-member insertion hole 55 and the stopper accommodating chamber 56.

The length of the cylindrical portion of the valve member 57 is adjusted such that the valve portion 58 is brought into close contact, by the stopper portion 59 and the cylindrical portion connected thereto, with a portion of the inner wall of the valve accommodating chamber 52, which portion is located at a lower part of the chamber 52 as viewed in FIG. 4, namely, a bottom wall of the valve accommodating chamber 52. By adjusting the length of the cylindrical portion, it is possible to adjust the magnitude of a force by which the valve portion 58 comes into close contact with the bottom wall of the valve accommodating chamber 52.

When the pressure in the above-described common gas chamber decreases and becomes not higher than a threshold that is lower than the atmospheric pressure as a result of consumption of the ink in any of the sub tanks 8*a*-8*d* by a printing operation, the force by which the valve portion 58 comes into close contact with the bottom wall of the valve accommodating chamber 52 cannot resist or withstand the difference between the decreased pressure and the atmospheric pressure, rendering it impossible to keep the valve portion 58 contacting the bottom wall of the valve accommodating chamber 52. Accordingly, the peripheral portion of the open end of the valve portion 58 deforms toward the communication hole 54 and separates away from the bottom wall of the valve accommodating chamber 52. In consequence, there is formed a clearance between the valve portion 58 and the bottom wall of the valve accommodating chamber 52, so as to permit communication between the common gas chamber and the exterior thereof. Accordingly, a gas is introduced into the common gas chamber through the clearance indicated above. When the pressure in the common gas chamber becomes higher than the threshold owing to the gas introduced thereinto, the difference between the pressure and the atmospheric pressure becomes small, so that the valve portion 58 is again brought into contact with the bottom wall of the valve accommodating chamber 52 by the above-described force. Accordingly, the common gas chamber can be hermetically closed. In the arrangement described above, it is possible to control the pressure in the common gas chamber so as to become higher than the threshold that is smaller than the atmospheric pressure.

In the pressure control valve 50 constructed as described above, the stopper portion 59 and the cylindrical portion of valve member 57 are inhibited from moving owing to the contact of the stopper portion 59 with the inner wall of the stopper accommodating chamber 56, whereby the valve portion 58 is closely contacts the bottom wall of the valve accommodating chamber 52. In place of the stopper portion 59, there may be provided a biasing member configured to bias the valve portion 58 in a direction toward the communication hole 53, whereby the common gas chamber is hermetically closed with respect to the exterior thereof by the valve portion 58 biased by the biasing member.

Figure 5:
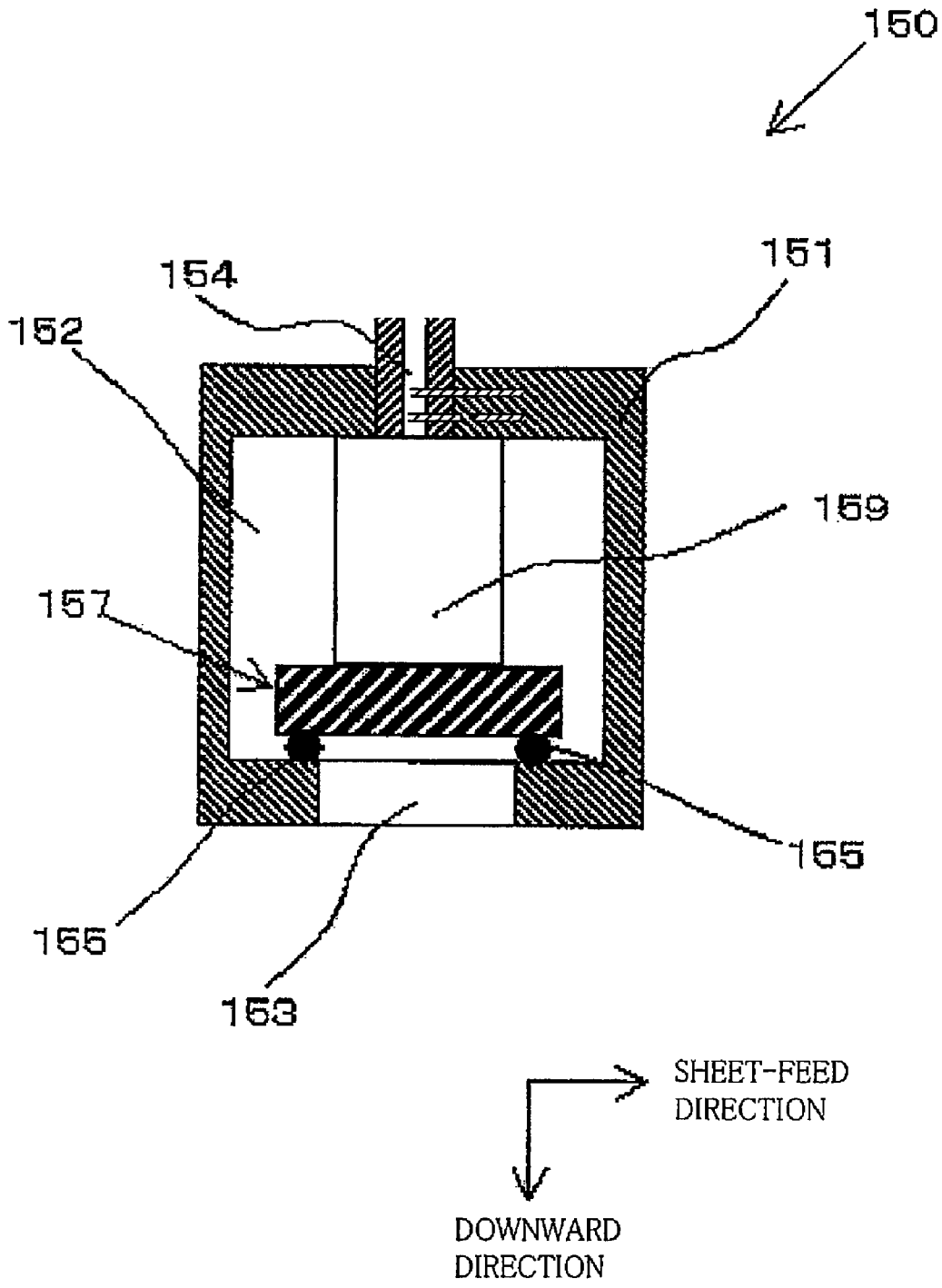
FIG. 5 is a cross-sectional view of a modified example of the pressure control valve.

With reference to FIG. 5, a pressure control valve 150 as modified example of the pressure control valve 50 will be explained. As shown in FIG. 5, the pressure control valve 150 has a casing 151 in which are formed a valve accommodating chamber 152, a communication hole 153 for communication between the valve accommodating chamber 152 and an exterior thereof and a communication hole 154 for communication between the valve accommodating chamber 152 and the inner space of the tube 20. The communication hole 154 is connected to the communication portion of the tube 20. A packing 155 is provided on a bottom wall of the valve accommodating chamber 152 so as to extend around the periphery of the communication hole 153. A valve member 157 is disposed in the valve accommodating chamber 152, and an elastic member 159 is connected to the valve member 157 on one side thereof remote from the communication hole 153. The elastic member 159 biases the valve member 157 in a direction toward the communication hole 153, whereby the valve member 157 is brought into contact with the packing 155. Accordingly, the gas is inhibited from flowing between the communication hole 153 and the valve accommodating chamber 152.

In a state in which the pressure in the common gas chamber is not higher than the threshold that is lower than the atmospheric pressure, the magnitude of the biasing force of the elastic member 159 is smaller than a force which acts on the valve portion 157 so as to draw the valve portion 157 toward the common gas chamber due to the difference between the pressure in the common gas chamber and the atmospheric pressure. In a state in which the pressure in the common gas chamber is higher than the threshold, the magnitude of the biasing force of the biasing member 159 is larger than the force which acts on the valve portion 157 so as to draw the valve portion 157 toward the common gas chamber. According to the arrangement, when the pressure in the common gas chamber becomes not higher than the threshold, the difference between the pressure in the common gas chamber and the atmospheric pressure becomes large, whereby the valve member 157 is drawn toward the communication hole 154 to form a clearance between the valve member 157 and the packing 155, and the gas is introduced into the valve accommodating chamber 152 through the clearance. In the state in which the pressure of the common gas chamber is higher than the threshold, the valve portion 157 closely contacts the packing 155 and accordingly the common gas chamber is hermetically closed, so that the pressure in the valve accommodating chamber 152 increases. Accordingly, when the pressure in the common gas chamber becomes higher than the threshold, the difference between the atmospheric pressure and the pressure in the common gas chamber becomes smaller than a prescribed value. Therefore, the valve member 157 contacts the packing 155 by the biasing force of the elastic member 159, so that the common gas chamber can be hermetically closed with respect to the exterior thereof.

Figure 6:
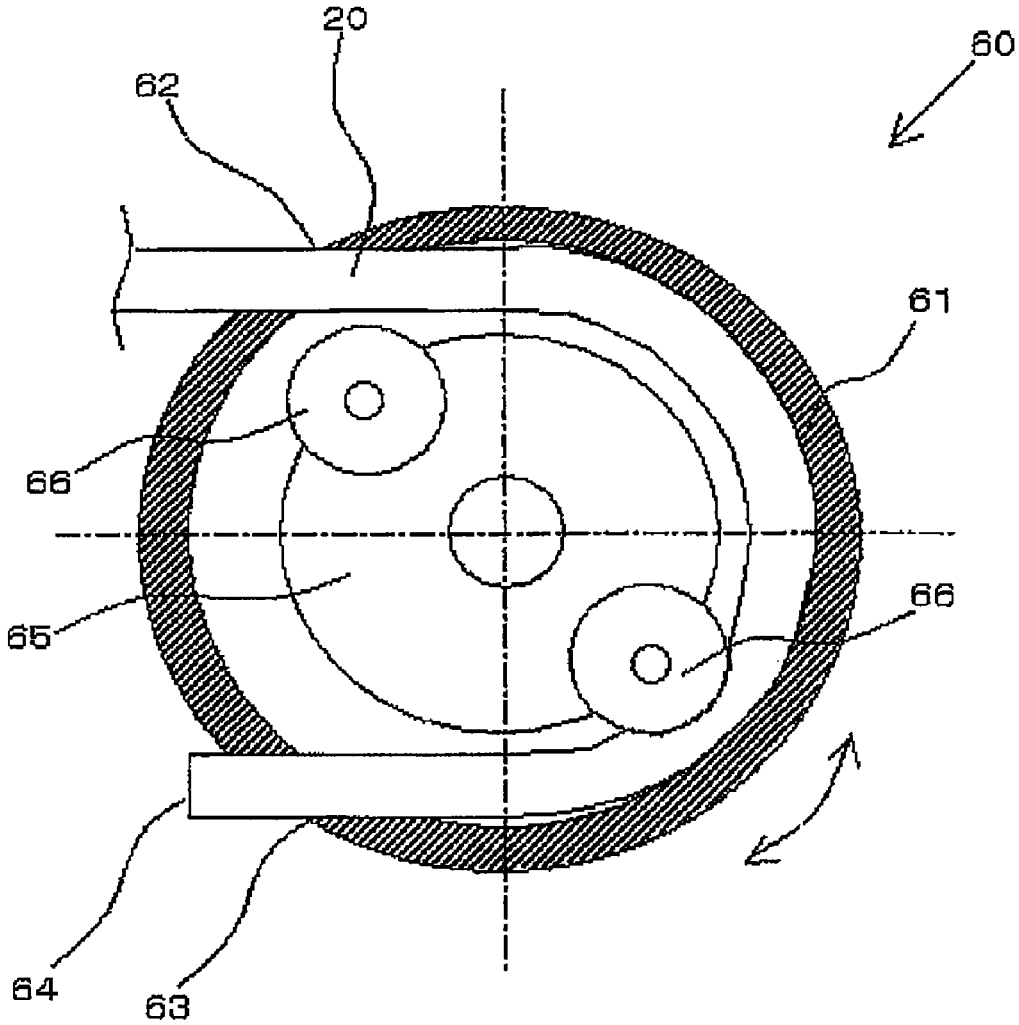
FIG. 6 is a cross-sectional view of the pump.

Next, the pump 60 will be explained with reference to FIG. 6. The pump 60 used in the present embodiment is a tube pump. As shown in FIG. 6, the pump 60 includes a casing 61 in which a part of the tube 20 is disposed. More specifically explained, the tube 20 is inserted into an inner space of the casing 61 through a through-hole 62 formed in the casing 61. In the inner space of the casing 61, the tube 20 is disposed so as to be in contact with an inner wall of the casing 61 at a right-side half portion of the inner space of the casing 61 as seen in FIG. 6. The tube 20 protrudes out of the inner space of the casing 61 through another through-hole 63 formed in the casing 61. The inner space of the tube 20 and the exterior of the tube 20 communicate with each other through an opening formed at the other end 64 of the tube 20.

In the casing 61, there is disposed a rotary member 65 connected to a drive motor not shown. The rotary member 65 is a disc-like member and has a diameter smaller than the inner space of the casing 61. The rotary member 65 is configured to be rotated, by the drive motor, in one of a clockwise direction or a counterclockwise direction about a center thereof at which the rotary member 65 is connected to the drive motor. Further, two rollers 66, 66 are respectively disposed on two diametrically opposite portions of the rotary member 65 that are spaced apart from each other by 180° in the circumferential direction. The rollers 66 has a size that permits the tube 20 to be pressed by the rollers 66 so as to close the inner space of the tube 20. Accordingly, the inner space of the tube 20 and the exterior of the tube 20 can be placed in a non-communicating state. In the arrangement wherein the two rollers 66 are circumferentially spaced apart from each other by 180°, at least one of the two rollers 66 can press the tube 20 toward the inner wall of the casing 61 when the pump 60 is driven. Accordingly, the inner space of the tube 20 and the exterior thereof can be always kept in the non-communicating state, whereby the common gas chamber that is partially constituted by the inner space of the tube 20 is inhibited from communicating with the exterior through the opening at the other end 64 of the tube 20. Thus, the common gas chamber can be hermetically closed.

In the present embodiment, the pressure control valve 50, 150 is disposed in the vicinity of the tube 20 to open and close the communication portion of the tube 20. As a design option, it may be possible to dispose the pressure control valve 50, 150 in the intra-body common chamber which is a part of the common gas chamber. In this instance, however, there is a limitation as to location of the pressure control valve 50, 150 in the intra-body common chamber for the following reasons. Because the intra-body common chamber is formed so as to be in communication with all of the plurality of sub tanks 8*a*-8*d* and the gas-permeable membranes 26*a*-26*d* are disposed, the pressure control valve 50, 150 needs to be disposed so as not to interfere with those components. In the present embodiment, however, the pressure control valve 50, 150 is disposed in the vicinity of the tube 20 as described above. Accordingly, it is not necessary in the present embodiment to consider the risk of interference of the control valve 50, 150 with the components in the intra-body common chamber, unlike the arrangement in which the pressure control valve 50, 150 is disposed in the intra-body common chamber. Accordingly, the present embodiment ensures a higher degree of freedom in disposing the pressure control valve 50, 150 than the arrangement in which the pressure control valve 50, 150 is disposed in the intra-body common chamber.

Figure 7:
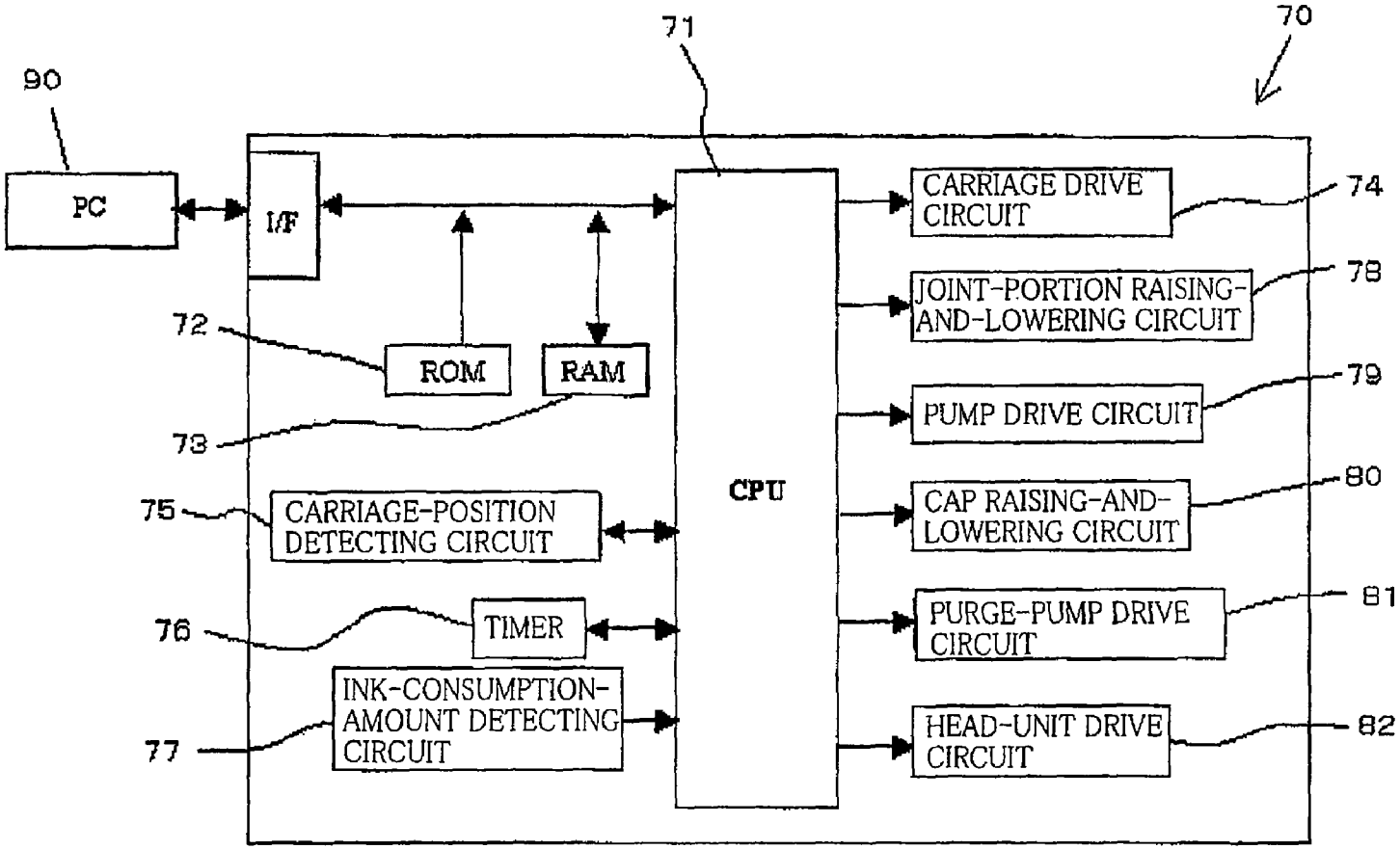
FIG. 7 is a block diagram showing an electric configuration of the ink jet printer.

Referring next to the block diagram of FIG. 7, there will be explained an electric configuration of the ink-jet printer 1. As shown in FIG. 7, a controller 70 for controlling the ink-jet printer 1 includes a CPU (Central Processing Unit) 71, a ROM (Read Only Memory) 72 which stores various programs and data for controlling the ink-jet printer 1, and a RAM (Random Access Memory) 73 which temporarily stores data processed by the CPU 71.

The CPU 71 receives, via an interface, data indicative of characters and images to be recorded, from an input device 90 such as a personal computer (PC). The controller 70 further includes: a carriage drive circuit 74 for driving the carriage drive motor 6; a carriage-position detecting circuit 75 that is connected to a sensor (not shown) for detecting a position of the carriage 5; a timer 76 for measuring a time elapsed after a previous printing operation; an ink-consumption-amount detecting circuit 77 that is connected to a detector for detecting an amount of ink consumed after the ink has been supplied to each of the sub tanks 8*a*-8*d*; a joint-portion raising-and-lowering circuit 78 that is connected to a joint-portion raising-and-lowering mechanism (not shown) which supports the joint portions 12*a*-12*d* for raising and lowering the same 12*a*-12*d* so as to place the sub tanks 8*a*-8*d* and the ink cartridges 11*a*-11*d* in a mutually communicating state or in a non-communicating state; a pump drive circuit 79 for driving the pump 60 when the sub tanks 8*a*-8*d* and the ink cartridges 11*a*-11*d* are in the mutually communicating state; a cap raising-and-lowering circuit 80 that is connected to the cap raising-and-lowering mechanism which vertically moves the cap 14 such that the cap 14 comes into contact with the nozzle surface of the head unit 9 at the above-described liquid-supply position of the carriage 5 for the purging operation, when it is judged that the elapsed time after the previous printing operation measured by the timer 76 exceeds a prescribed time; a purge-pump drive circuit 81 for driving the purge pump 18 for the purging operation; and a head-unit drive circuit 82 for controlling a pressure-giving device which gives a pressure to the ink stored in the pressure chambers for ejecting the ink through the corresponding nozzles. The circuits, 74, 75, 77-82 and the timer 76 are connected to the CPU 71.

In the present embodiment, the joint portions 10*a*-10*d* and 12*a*-12*d*, and the joint-portion raising-and-lowering mechanism for vertically moving the joint portions 12*a*-12*d* constitute a first communication-state changing device. The first communication-state changing device is operated by the CPU 71, the carriage-position detecting circuit 75, the timer 76, the ink-consumption-amount detecting circuit 77, and the joint-portion raising-and-lowering circuit 78.

In the present ink-jet printer 1, the sub tanks 8*a*-8*d* are not held in communication with the ink cartridges 11*a*-11*d* when a printing operation is performed. Therefore, even though the ink in the sub tanks 8*a*-8*d* is consumed in the printing operation, the ink cannot be supplied to the ink cartridges 11*a*-11*d* during the printing operation. Accordingly, when the ink in the sub tanks 8*a*-8*d* is consumed to a certain extent, the carriage 5 is moved to the liquid-supply position at which the sub tanks 8*a*-8*d* and the ink cartridges 11*a*-11*d* can communicate with each other, and the ink is supplied from the ink cartridges 11*a*-11*d* to the sub tanks 8*a*-8*d*. Here, a mode in which the operation of ejecting ink droplets during printing is executed is referred to as "an ejection mode" while a mode in which the operation of supplying the ink from the ink cartridges 11*a*-11*d* to the sub tanks 8*a*-8*d* is executed is referred to as "a supply mode".

Figure 8:
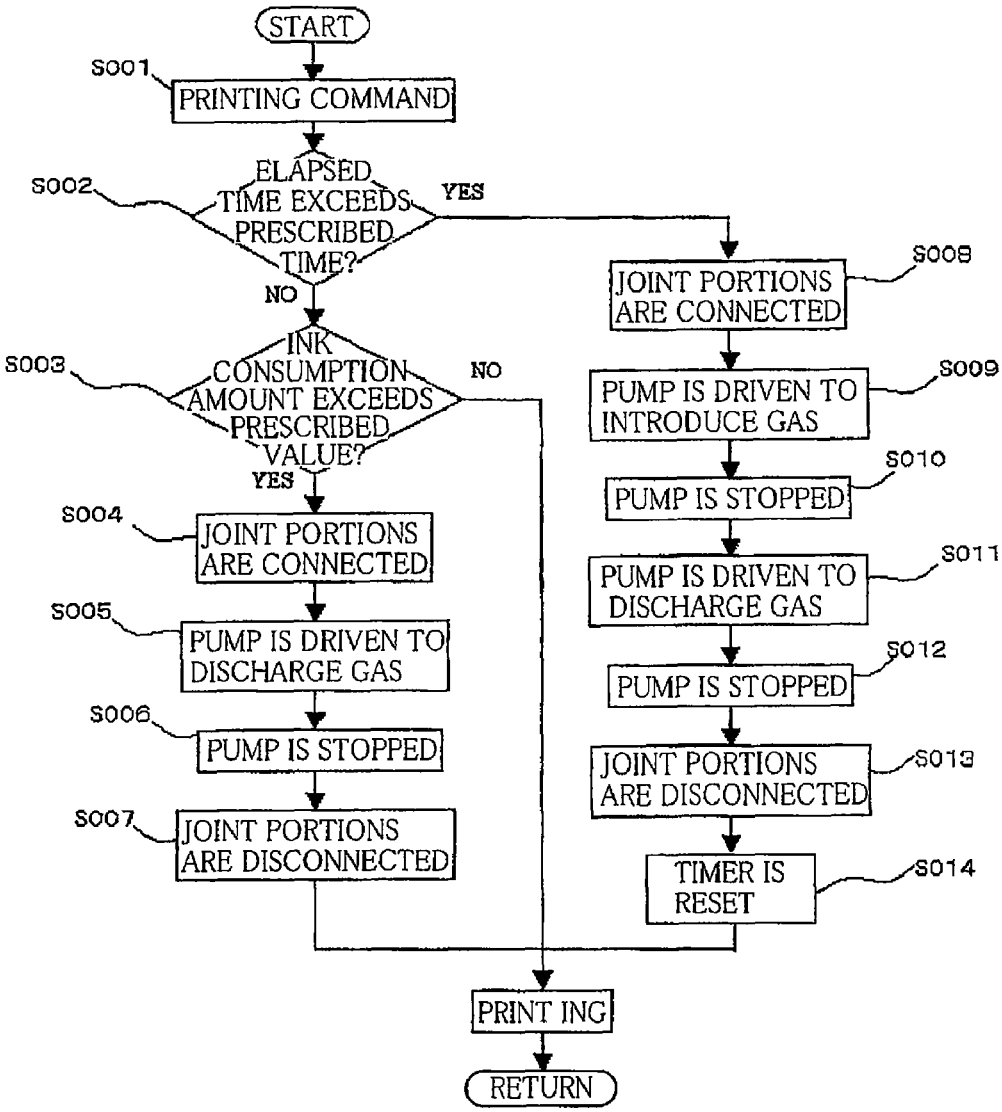
FIG. 8 is a flow chart showing operations controlled by a control circuit.
Figure 9:
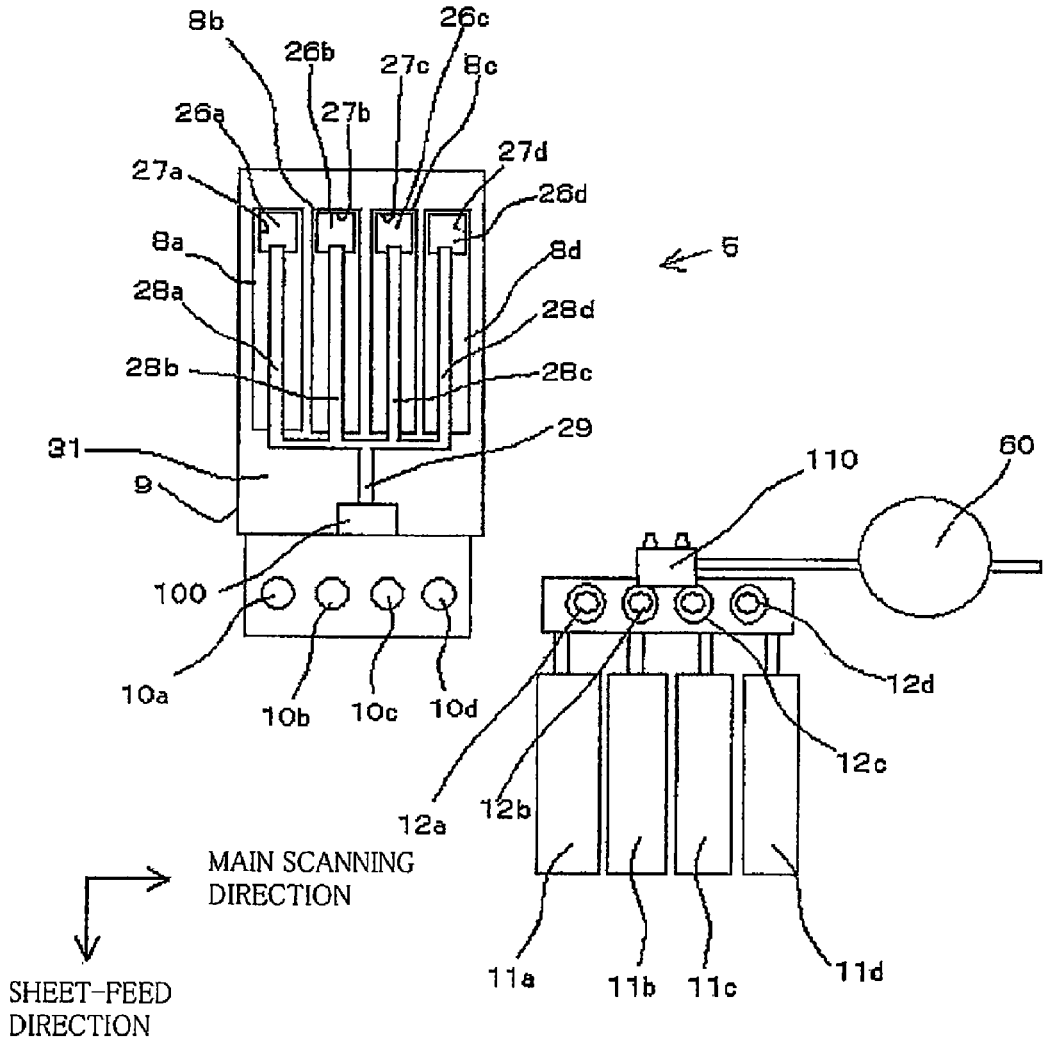
FIG. 9 is a plan view showing an ink-jet printer according to a second embodiment to the invention.
Figure 10:
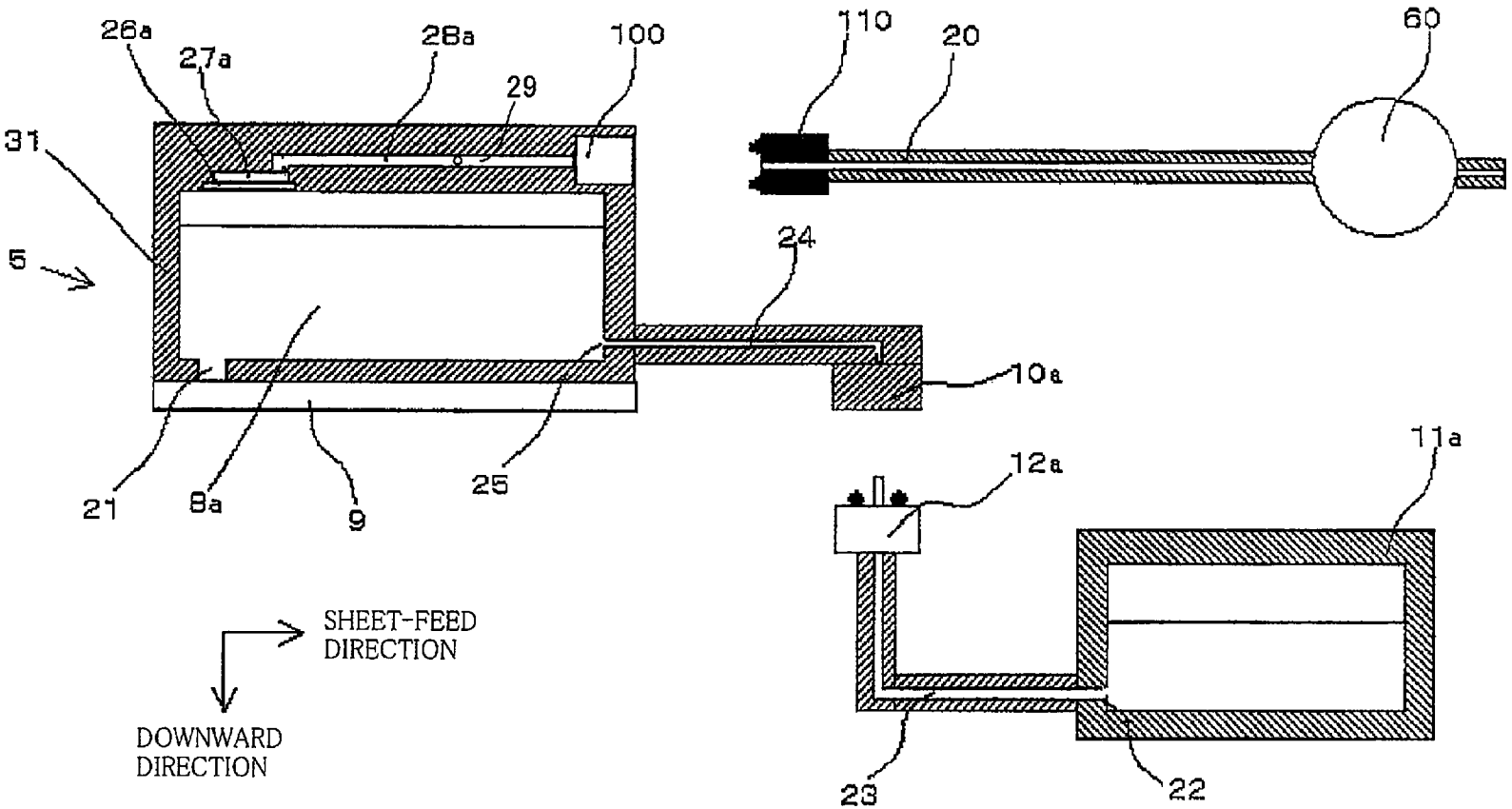
FIG. 10 is a cross-sectional view of the ink-jet printer of FIG. 9.

Referring to the flow chart of FIG. 8, the operations in the ejection mode and the supply mode controlled by the controller 70 will be explained.

Initially, processing executed by the CPU 71 will be explained. The CPU 71 judges whether the carriage 5 is located at the liquid-supply position based on a result of detection obtained by the carriage-position detecting circuit 75. Where the carriage 5 is not located at the liquid-supply position, the CPU 71 executes processing for moving the carriage 5 to the liquid-supply position. Where the carriage 5 is located at the liquid-supply position, the CPU 71 executes processing for keeping the carriage 5 at the liquid-supply position on standby. In a state in which the carriage 5 is located at the liquid-supply position, the CPU 71 permits a signal indicative of a printing command to be inputted thereto by an operation of a user through the input device 90 (step S001). When the signal is inputted, the CPU 71 receives, from the input device 90, data of images to be recorded, and the data is temporarily stored in the RAM 73. Subsequently, the CPU 71 sends a signal to the timer 76 and receives, from the timer 76, data indicative of the elapsed time after the previous printing operation (S002). Where the CPU 71 judges, based on the data received from the timer 76, that the elapsed time is shorter than the prescribed time (S002: NO), the CPU 71 receives from a signal from the ink-consumption-amount detecting circuit 77 and obtains an amount of ink consumed in each sub tank 8*a*-8*d* after a previous ink supply operation, namely, obtains an amount of ink remaining in each sub tank 8*a*-8*d* (S003). Here, the prescribed time used in the judgment in S002 is defined as follows. If the elapsed time after the previous printing operation is longer than the prescribed time, the viscosity of the ink increases to such an extent that the ink ejection is adversely influenced. Returning back to the flow chart, where it is judged in S003 that the ink consumption amount in each sub tank 8*a*-8*d* exceeds a prescribed value (S003: YES), the CPU 71 reads a program for the supply mode from the ROM 72 and executes the program. According to the program, the CPU 71 initially sends a drive signal for raising the joint portions 12*a*-12*d* to the joint-portion raising-and-lowering circuit 78 for driving the joint-portion raising-and-lowering mechanism (S004). The joint portions 12*a*-12*d* are raised by the joint-portion raising-and-lowering mechanism to a position at which the joint portions 12*a*-12*d* can be connected respectively to the joint portions 10*a*-10*d*. When the joint portions 12*a*-12*d* and the joint portions 10*a*-10*d* are connected, the sub tanks 8*a*-8*d* and the ink cartridges 11*a*-11*d* are placed in the mutually communicating state. After the joint portions 12*a*-12*d* and the joint portions 10*a*-10*d* are connected, the CPU 71 sends, to the pump drive circuit 79, a signal for driving the pump 60 for evacuation of the sub tanks 8*a*-8*d*, so that the pump 60 operates to discharge the gas from the sub tanks 8*a*-8*d* (S005). After the pump 60 has operated for a certain time period, the CPU 71 stops the pump 60 via the pump drive circuit 79 (S006).

By the operation of the pump 60 for the certain time period, the ink is supplied from the ink cartridges 11*a*-11*d* to the sub tanks 8*a*-8*d* until the ink surface in each sub tank 8*a*-8*d* comes into contact with the corresponding gas-permeable membrane 26*a*-26*d*, namely, until each sub tank 8*a*-8*d* is filled with the ink.

Thereafter, the CPU 71 sends a drive signal for lowering the joint portions 12*a*-12*d* to the joint-portion raising-and-lowering circuit 78 for driving the joint-portion raising-and-lowering mechanism, so that the joint portions 12*a*-12*d* are lowered and accordingly disconnected from the joint portions 10*a*-10*d* (S007). After the joint portions 12*a*-12*d* have been disconnected from the joint portions 10*a*-10*d*, the CPU 71 reads the data from the RAM 73 stored temporarily in S001 and sends a drive signal based on the read data to the head-unit drive circuit 82, so that the head unit 9 operates to eject the ink droplets from the nozzles for printing the image based on the data, on a recording sheet.

Where it is judged in S003 that the detected ink consumption amount is lower than the prescribed value (S003: NO), the CPU 71 reads out the data temporarily stored in the RAM 73 and sends the drive signal based on the read data to the head-unit drive circuit 82, so that the head unit 9 performs printing.

Here, it is understood that the controller 70 has a first communication-state control portion. The first communication-state control portion is configured to permit the joint portions 10*a*-10*d* and the joint portions 12*a*-12*d* to be connected by driving the joint-portion raising-and-lowering mechanism for placing the sub tanks 8*a*-8*d* and the ink cartridges 11*a*-11*d* in the mutually communicating state, when the CPU 71 judges in S003, based on the data indicative of the ink consumption amount detected by the ink-consumption-amount detecting circuit 77, that the ink consumption amount exceeds the prescribed value (S003: YES). Further, the first communication-state control portion is configured to drive the carriage drive device in place of driving the joint-portion raising-and-lowering mechanism and to permit the head unit 9 to perform printing with the sub tanks 8*a*-8*d* and the ink cartridges 11*a*-11*d* placed in the non-communicating state, when the CPU 71 judges in S003, based on the data indicative of the ink consumption amount detected by the ink-consumption-amount detecting circuit 77, that the ink consumption amount does not exceed the prescribed value (S003: NO).

Next, there will be explained a viscosity-recovery mode as a modification mode in the above-indicated supply mode. As indicated in the flow chart of FIG. 8, the CPU 71 receives the signal of the printing command from the input device 90 (S001) and subsequently receives, from the timer 76, the data indicative of the elapsed time after the previous printing operation (S002). Where the CPU 71 judges, based on the data received from the timer 76, that the elapsed time after the previous printing operation is longer than the prescribed time (S002; YES), the CPU 71 reads out a program for the viscosity-recovery mode from the ROM 72 and executes the program. In the program, the CPU 71 initially sends a drive signal to the joint-portion raising-and-lowering circuit 78 for driving the joint-portion raising-and-lowering mechanism, whereby the joint portions 12*a*-12*d* are raised so as to be connected to the joint portions 10*a*-10*d*, so that the sub tanks 8*a*-8*d* and the ink cartridges 11*a*-11*d* are placed in the mutually communicating state (S008). Subsequently, the CPU 71 sends a drive signal to the pump drive circuit 79 for driving the pump 60 to introduce a gas into the sub tanks 8*a*-8*d*, so that the pump 60 is driven to introduce the gas into the sub tanks 8*a*-8*d* (S009). When the pump 60 continues to be driven, the pressure in each sub tank 8*a*-8*d* increases up to a predetermined value. At this moment, the ink in the sub tanks 8*a*-8*d* starts to flow into the ink cartridges 11*a*-11*d* via the joint portions 10*a*-10*d* and the joint portions 12*a*-12*d*. The pump 60 is kept driven for a certain time period such that the ink in the sub tanks 8*a*-8*d* completely flows into the ink cartridges 11*a*-11*d*. After the certain time period has passed, the CPU 71 stops the pump 60 via the pump drive circuit 79 (S010). Subsequently, in the state in which the joint portions 10*a*-10*d* and the joint portions 12*a*-12*d* are connected, the CPU 71 drives the pump 60 via the pump drive circuit 79 for evacuation of the sub tanks 8*a*-8*d* as in S005, so that the pump 60 is driven to discharge the gas in the sub tanks 8*a*-8*d* (S011). As in S006, the pump 60 is driven for a certain time period until the four sub tanks 8*a*-8*d* are filled with the ink. After the certain time period has passed, the CPU 71 stops the pump 60 via the pump drive circuit 79 (S012). Subsequently, the CPU 71 drives the joint-portion raising-and-lowering mechanism via the joint-portion raising-and-lowering circuit 78 to lower the joint portions 12*a*-12*d*, so that the joint portions 12*a*-12*d* are lowered and accordingly disconnected from the joint portions 10*a*-10*d* (S013). After the joint portions 12*a*-12*d* have been disconnected from the joint portions 10*a*-10*d*, the CPU 71 resets the time count of the timer 76 (S014). Thus, one execution of the viscosity-recovery mode is completed. After the joint portions 12*a*-12*d* have been disconnected from the joint portions 10*a*-10*d*, the CPU permits the head unit 9 to perform printing via the head-unit drive circuit 82.

In replenishing the sub tanks 8*a*-8*d* with the ink, the processing in S009-S013 is executed, before printing, under the predetermined condition, whereby the ink in each sub tank 8*a*-8*d* is mixed with the ink in the corresponding ink cartridge 11*a*-11*d* having a lower viscosity than the ink in the sub tank 8*a*-8*d*. Accordingly, even when the printing is performed after a long time has passed since the last or previous ejection of the ink, the viscosity of the ink in each sub tank 8*a*-8*d* can be lowered so as to recover to a normal level, thereby obviating printing with the otherwise thickened ink while returning the ink having the viscosity that does not adversely influence the ink ejection characteristic, back to the sub tanks 8*a*-8*d* from the ink cartridges 11*a*-11*d*. Therefore, the ink thickened during a long non-ejection period can be reused without being discarded, thereby decreasing an amount of the ink discarded.

In the present ink-jet printer 1 wherein the carriage 5 is reciprocatingly moved in the ejection mode, the length of the tube 20 needs to be larger than a maximum distance between the carriage 5 and the pump 60 when the carriage 5 is located the most distant from the pump 60, for permitting the tube 20 to follow the carriage 5 being reciprocatingly moved. Where the length of the tube 20 is large, the inner space of the tube 20 accordingly becomes large, thereby increasing the volume of the common gas chamber.

When the direction of the reciprocating movement of the carriage 5 is changed, the movement of the carriage 5 accelerates or decelerates, so that an inertial force acts on the tube 20 that follows the movement of the carriage 5, due to the acceleration or deceleration. Accordingly, in an arrangement in which a pressure control valve is moved together with the tube 20, the inertial force may act on the pressure control valve, thereby causing a risk of accidentally opening the communication portion. In the present embodiment, however, the pressure control valve 50, 150 is fixed to the casing 2, obviating the risk of opening the communication portion described above.

Referring next to FIGS. 9-12, there will be explained an ink-jet printer according to a second embodiment. In the second embodiment, the same reference numerals as used in the illustrated first embodiment are used to identify the corresponding components, and a detailed explanation of which is dispensed with.

The ink-jet printer 1 of the second embodiment differs from the ink-jet printer 1 of the first embodiment in a communication structure between the sub tanks 8*a*-8*d* and the pump 60.

As in the illustrated first embodiment, the sub tank 8*a*-8*d* are formed in the box-like body 31. The sub tanks 8*a*-8*d* communicate, via the respective gas permeable membranes 26*a*-26*d*, with the respective recesses 27*a*-27*d*, the respective gas passages 28*a*-28*d*, and the common gas passage 29. As in the illustrated first embodiment, the intra-body common chamber is constituted by the recesses 27*a*-27*d*, the gas passages 28*a*-28*d*, and the common gas passages 29. In the present embodiment, a first joint portion 100 is provided at an opening of the common gas passage 29 communicating with an exterior thereof. The opening is located at an end portion of the common gas passage 29. Further, a second joint portion 110 is provided so as to communicate with the pump 60. The second joint portion 110 is configured to be connected to the first joint portion 100 in the supply mode.

The first joint portion 100 is configured to open and close a communication portion, namely, the end portion of the common gas passage 29, through which the intra-body common chamber and an exterior thereof communicate with each other. In the ejection mode described above, the communication portion is kept closed. In the supply mode, the second joint portion 110 is connected to the first joint portion 100 for communication between the intra-body common chamber and the pump 60.

Figure 11:
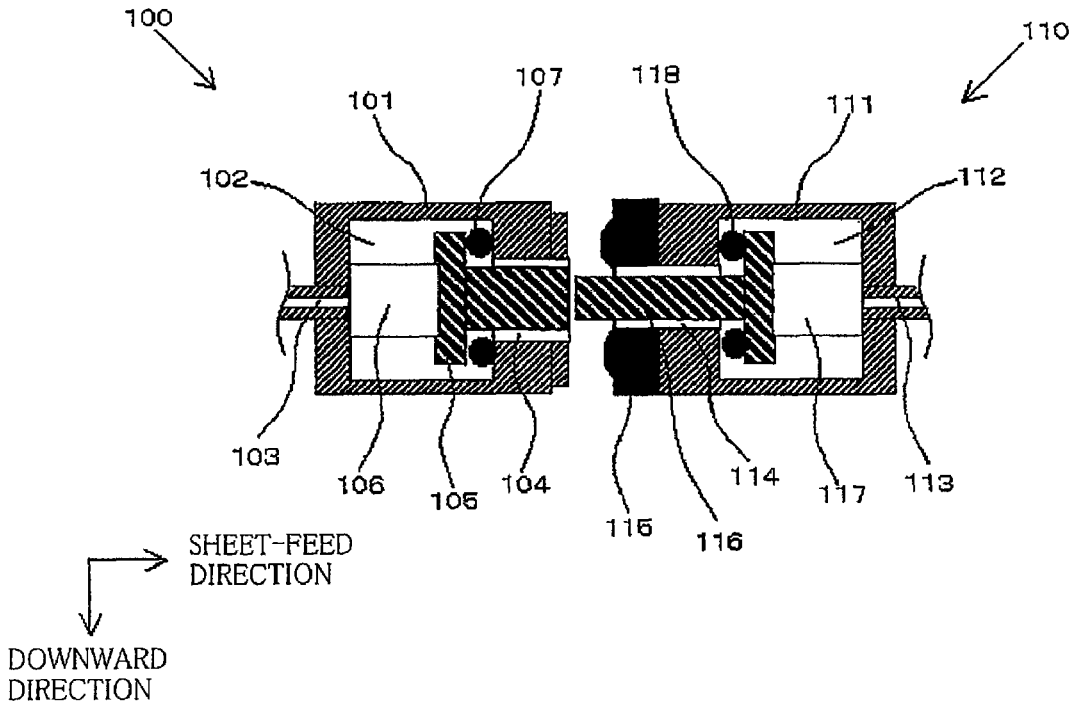
FIG. 11 is a cross-sectional view of first and second joint portions.
Figure 12:
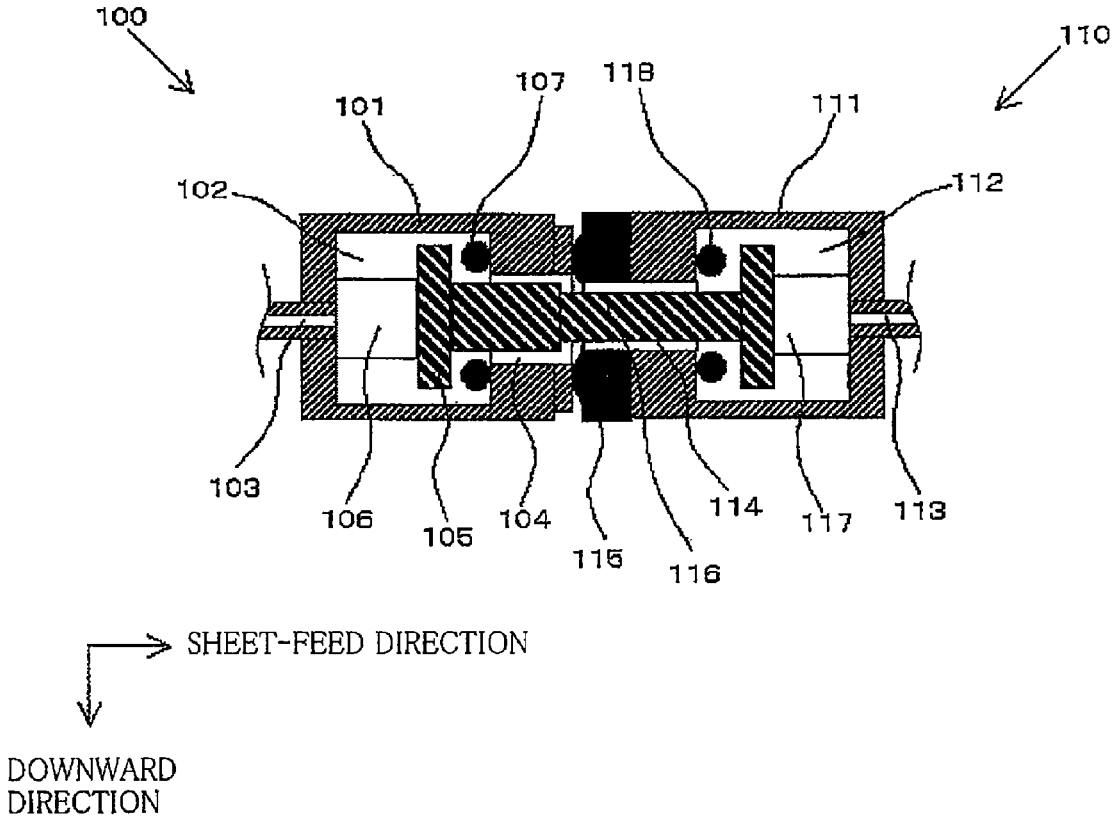
FIG. 12 is a view showing a state in which the first and second joint portions of FIG. 11 are connected to each other.

The first and second joint portions 100, 110 will be explained with reference to FIGS. 11 and 12. FIG. 11 shows a state in which the first and second joint portions 100, 110 are not connected to each other. FIG. 12 shows a state in which the first and second joint portions 100, 110 are connected to each other for communication between the intra-body common chamber and the pump 60.

Initially, the first joint portion 100 will be explained. As shown in FIGS. 11 and 12, the first joint portion 100 includes a casing 101 in which a joint-portion space chamber 102 is formed. The joint-portion space chamber 102 communicates with the intra-body common chamber via a communication hole 103 and further communicates with the sub tanks 8*a*-8*d*. The joint-portion space chamber 102 is connected to a communication hole 104 as the communication portion through which the joint-portion space chamber 102 and an exterior thereof can be held in communication with each other. In the joint-portion space chamber 102, there is disposed a valve member 105 having a larger size than an area of opening of the communication hole 104. To the valve member 105, an elastic member 106 is connected for biasing the valve member 105 in a direction toward the communication hole 104. At an open end portion of the joint-portion space chamber 102 connected to the communication hole 104, a packing 107 provided by a member having elasticity is disposed so as to extend around the periphery of the above-indicated open end portion of the chamber 102. The valve member 105 biased by the elastic member 106 toward the communication hole 104 is pressed onto the packing 107, thereby inhibiting gas communication between the joint-portion space chamber 102 and the communication hole 104. Thus, the valve member 105 is pressed onto the packing 107, whereby the valve member 105 is displaced to its closed position at which the communication hole 104 is closed.

The valve member 105 is pressed onto the packing 107 as shown in FIG. 11, whereby the joint-portion space chamber 102 and its exterior are inhibited from communicating with each other. Accordingly, the joint-portion space chamber 102 cooperates with the intra-body common chamber to constitute the common gas chamber.

The magnitude of the biasing force of the elastic member 106 by which the valve member 105 is biased toward the packing 107 is determined such that the biasing force permits a movement of the valve member 105 in a direction away from the communication hole 104 as a result of yielding to the atmospheric pressure, namely, due to a difference between the pressure in the common gas chamber and the atmospheric pressure, when the pressure in the common gas chamber becomes not higher than the threshold that is lower than the atmospheric pressure. The arrangement enables the first joint portion 100 to function like the pressure control valve 50, 150 in the illustrated first embodiment for controlling the pressure in the common gas chamber.

Next, the second joint portion 110 will be explained. As shown in FIGS. 11 and 12, the second joint portion 110 includes a casing 111 in which a joint-portion space chamber 112 is formed. The joint-portion space chamber 112 communicates with the pump 60 via a communication hole 113. Further, the joint-portion space chamber 112 is connected to a communication hole 114 through which the chamber 112 can communicate with an exterior thereof. The communication hole 114 is open to the outer surface of the casing 111 and is provided with a seal member 115 at its open end such that the seal member 115 extends around the periphery of the open end. A valve opening member 116 is inserted through the communication hole 114 so as to protrude in a leftward direction in FIG. 11 by a distance larger than a distance by which the seal member 115 protrudes in the same direction. An elastic member 117 is connected to the valve opening member 116 for biasing the same 116 in a direction toward the communication hole 114. Further, at an open end portion of the joint-portion space chamber 112 connected to the communication hole 114, a packing 118 is disposed so as to extend around the periphery of the open end portion. The packing 115 is pressed by a part of the valve opening member 116 that is biased by the elastic member 117 in the direction toward the communication hole 114.

In the above arrangement, when the first and second joint members 100, 110 are connected to each other, the valve opening member 116 enters the communication hole 104, whereby the valve member 105 is pushed in the direction away from the communication hole 104 while, at the same time, the valve opening member 116 is pushed in a direction away from the communication hole 114 by the biasing force of the elastic member 106 that biases the valve member 105. As a result, there is formed a clearance between the valve member 105 and the packing 107 while there is formed a clearance between the valve opening member 116 and the packing 118. Further, the seal member 115 is brought into close contact with the outer surface of the casing 101 of the first joint portion 100. Accordingly, the communication hole 104 and the communication hole 114 are brought into communication with each other while being hermetically closed with respect to the exterior owing to the seal member 115. Thus, when the first and second joint portions 100, 110 are connected to each other, the sub tanks 8*a*-8*d* and the pump 60 can be held in communication with each other while being hermetically closed with respect to the exterior.

In the present embodiment, the first joint portion 100 is not connected to the second joint portion 110 in the ejection mode. Accordingly, the valve member 105 is kept located at its closed position at which the communication hole 104 is closed, by the biasing force of the elastic member 106. However, when the pressure in the common gas chamber becomes not higher than the threshold, the valve member 105 is displaced to its open position, so that the pressure in the common gas chamber is instantaneously increased so as to become higher than the threshold. Thus, the valve member 105 and the elastic member 106 of the first joint portion 100 serve to stabilize the pressure in the common gas chamber. Therefore, it is possible to utilize the valve member 105 configured to open the communication hole 104 when the first and second joint portions 100, 110 are connected, as a pressure control valve for controlling the pressure in the common gas chamber. Accordingly, the number of required components can be reduced, so that the ink-jet printer 1 is offered at a reduced cost. Further, the reduction in the number of the required components simplifies the structure necessary for controlling the pressure in the intra-body common chamber and the common gas chamber.

Next, the electric configuration of the ink-jet printer 1 according to the second embodiment will be explained with reference to FIG. 7. The electric configuration in the second embodiment differs from that in the first embodiment in the construction of the joint-portion raising-and-lowering circuit 78 of the controller 70.

The joint-portion raising-and-lowering circuit 78 in the second embodiment is configured to not only drive the joint-portion raising-and-lowering mechanism to raise and lower the joint portions 12*a*-12*d*, but also drive a joint-portion moving mechanism to move the second joint portion 110. Alternatively, a drive circuit for moving only the second joint portion 110 may be connected to the CPU 71, aside from the joint-portion raising-and-lowering circuit 78.

In the present embodiment, the first and second joint portions 100, 110, and the joint-portion moving mechanism for moving the second joint portion 110 constitute a second communication-state changing device. The second communication-state changing device is operated by the CPU 71, the carriage-position detecting circuit 75, the ink-consumption-amount detecting circuit 77, and the joint-portion raising-and-lowering circuit 78 for driving the joint-portion moving mechanism to move the second joint portion 110.

Next, there will be explained an operation which is controlled by the controller 70 of the ink-jet printer 1 according to the second embodiment, with reference to the flow chart of FIG. 8 The operation controlled by the controller 70 of the second embodiment differs from that of the first embodiment in the construction of S004, S007, S008, S013 in the flow chart of FIG. 8 in which the joint portions are raised, lowered or moved for connection to and disconnection from the corresponding joint portions.

The CPU 71 judges, before printing is performed, whether the carriage 5 is located at the liquid-supply position, based on a signal of the carriage-position detecting circuit 75. In a state in which the carriage 5 is located at the liquid-supply position, the CPU 71 receives print data from the input device 90, and the data is temporarily stored in the RAM 73 (S001). Then the CPU 71 receives the timer 76 data indicative of an elapsed time after the previous printing operation (S002). Where the CPU 71 judges, based on the data received from the timer 76, that the above-indicated elapsed time is shorter than a prescribed time, the CPU 71 obtains an amount of the ink remaining in each of the sub tanks 8*a*-8*d*, based on a signal from the ink-consumption-amount detecting circuit 77 (S003). Where the CPU 71 judges in S003 that the ink consumption amount exceeds a prescribed value (S003: YES), the CPU 71 executes a program for the supply mode. According to the program, the CPU 71 initially sends, to the joint-portion raising-and-lowering circuit 78, a signal for driving the joint-portion raising-and-lowering mechanism to connect the joint portions 12*a*-12*d* to the joint portions 10*a*-10*d* while, at the same time, the CPU 71 sends, to the joint-portion raising-and-lowering circuit 78, a signal for driving the joint-portion moving mechanism to connect the second joint portion 110 to the first joint portion 100 (S004). Accordingly, the joint portions 12*a*-12*d* are connected to the joint portions 10*a*-10*d* while the second joint portion 110 is connected to the first joint portion 100, so that the sub tanks 8*a*-8*d* are brought into communication with the ink cartridges 11*a*-11*d* while the sub tanks 8*a*-8*d* are brought into communication with the pump 60.

Subsequently, the CPU 71 sends, to the pump drive circuit 79, a signal for driving the pump 60 for evacuation of the sub tanks 8*a*-8*d*, so that the pump 60 is driven to discharge the gas in each sub tank 8*a*-8*d* (S005). After a certain time period has passed, the CPU 71 stops the pump 60 via the pump drive circuit 79 (S006). Then the CPU 71 sends, to the joint-portion raising-and-lowering circuit 78, a signal for driving the joint-portion raising-and-lowering mechanism to disconnect or separate the joint portions 12*a*-12*d* from the joint portions 10*a*-10*d* while, at the same time, the CPU 71 sends, to the joint-portion raising-and-lowering circuit 78, a signal for driving the joint-portion moving mechanism to disconnect or separate the second joint portion 110 from the first joint portion (S007). Accordingly, the joint portions 12*a*-12*d* are disconnected from the joint portions 10*a*-10*d* while the second joint portion 110 is disconnected from the first joint portion 100, so that the sub tanks 8*a*-8*d* and the ink cartridges 11*a*-11*d* are placed in the non-communicating state while the sub tanks 8*a*-8*d* and the pump 60 are placed in the non-communicating state. Thereafter, the CPU 71 reads out, from the RAM 73, the print data received in S001 and permits the head unit 9 to perform printing on the recording sheet, via the head-unit drive circuit 82 (S007).

In the present embodiment, when the printing is performed on the recording sheet, the sub tanks 8*a*-8*d* and the ink cartridges 11*a*-11*d* are placed in the non-communicating state while, at the same time, the sub tanks 8*a*-8*d* and the pump 60 are also placed in the non-communicating state. Therefore, even if the pump 60 is accidentally driven in the ejection mode for performing printing, the gas is prevented, with high reliability, from being introduced into and discharged from the sub tanks 8*a*-8*d*, whereby it is possible to prevent the pressure in each sub tank 8*a*-8*d* from being changed and accordingly prevent a fluctuation in the ink ejection characteristics, due to malfunction of the pump 60 during printing.

In the present embodiment, in the supply mode, the carriage 5 is configured to be moved to the liquid-supply position. Further, the sub tanks 8*a*-8*d* and the ink cartridges 11*a*-11*d* are configured to be placed in the mutually communicating state when the carriage 5 is moved to the liquid-supply position. Similarly, the common gas chamber and the pump 60 are configured to be placed in the mutually communicating state when the carriage 5 is moved to the liquid-supply position. Accordingly, the present ink-jet printer 1 does not require, in the supply mode, a time individually for bringing the sub tanks 8*a*-8*d* and the ink cartridges 11*a*-11*d* into communication with each other and for bringing the common gas chamber and the pump into communication with each other, thereby shortening a time required when the ejection mode is changed into the supply mode. Therefore, the ink-jet printer 1 is speedy in operation.

Figure 13:
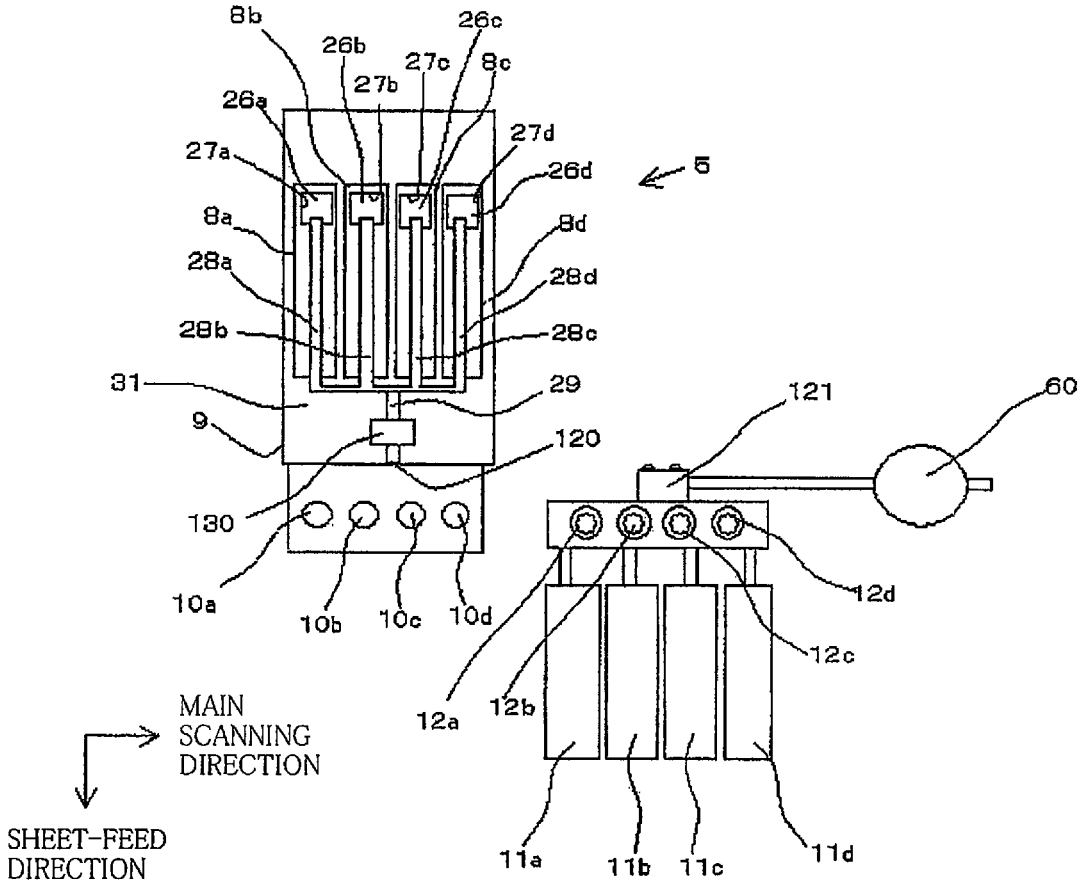
FIG. 13 is a plan view of an ink-jet printer according to a modified example of the second embodiment.
Figure 14:
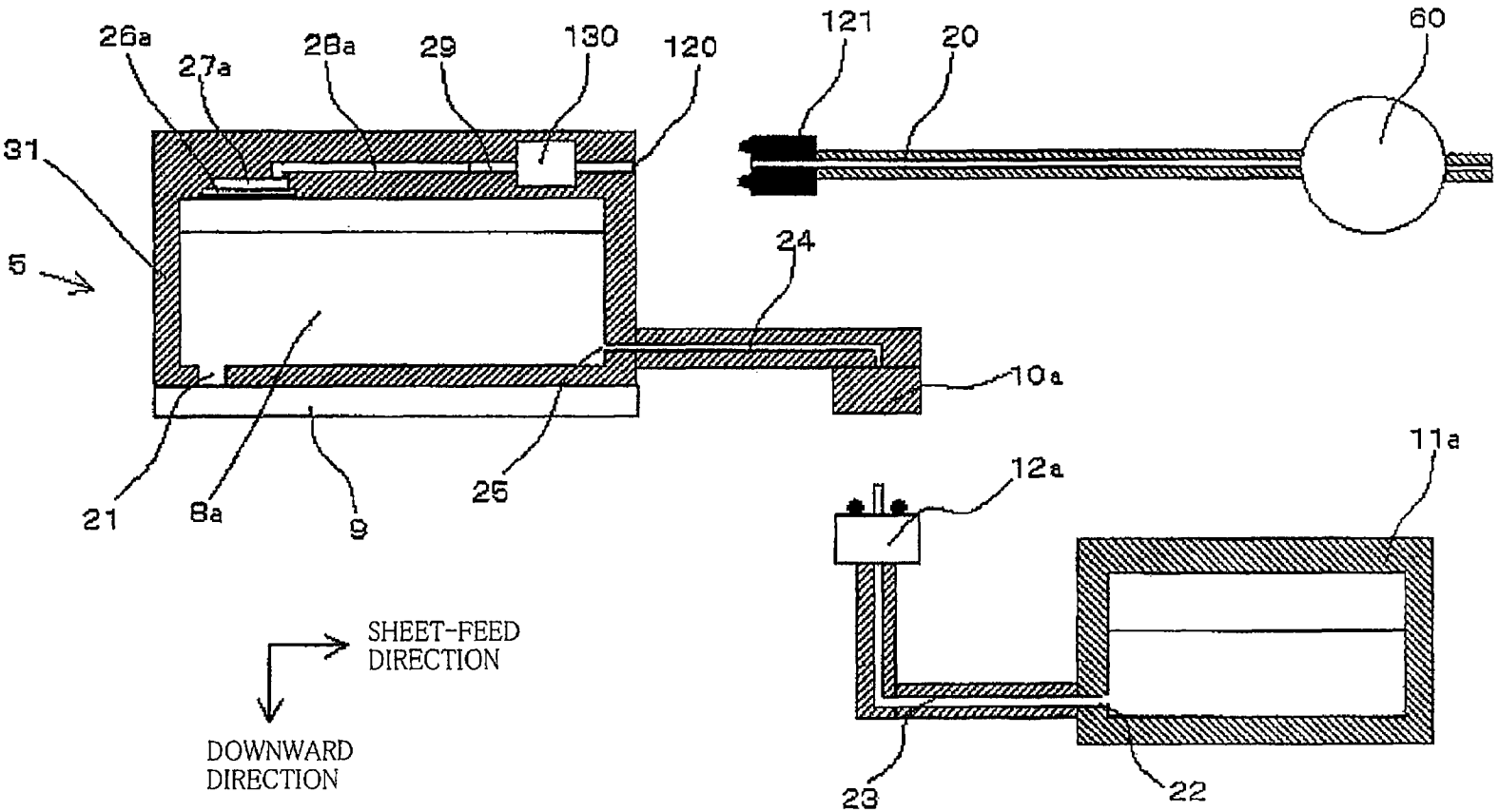
FIG. 14 is a cross-sectional view of the inkjet printer of FIG. 13.

In the ink-jet printer 1 according to the second embodiment, the two joint portions 100, 110 are provided, one of which is the first joint portion 100 communicating with the sub tanks 8*a*-8*d* and the other of which is the second joint portion 110 communicating with the pump 60. Only the second joint portion 110 may be provided as will be described in the following modified example shown in FIGS. 13-15. As shown in FIGS. 13 and 14, the ink-jet printer 1 according to the modified example includes the box-like body 31. On the outer surface of the box-like body 31, there is formed an opening 120 communicating with the common gas passage 29. A pressure control valve 130 is provided on the common gas passage 29. The pressure control valve 130 is configured to open and close a communication portion between the sub tanks 8*a*-8*d* and an exterior thereof. In the present embodiment, the communication portion is constituted by an end portion of the common gas passage 29 at which the opening 120 is provided. Further, the common gas chamber is constituted by a part of the common gas passage 29 located on one side of the pressure control valve 130 nearer to the sub tanks 8*a*-8*d*, the recesses 27*a*-27*d*, and the gas passages 28*a*-28*d*. In the supply mode, the joint portions 10*a*-10*d* and the joint portions 12*a*-12*d* are connected to each other for permitting communication between the ink cartridges 11*a*-11*d* and the sub tanks 8*a*-8*d* while a joint portion 121 communicating with the pump 60 is moved by the joint-portion moving mechanism so as to cover the opening 120. After the opening 120 has been covered by the joint portion 121, the pump 60 is driven to discharge or introduce the gas from or into the sub tanks 8*a*-8*d*.

Figure 15:
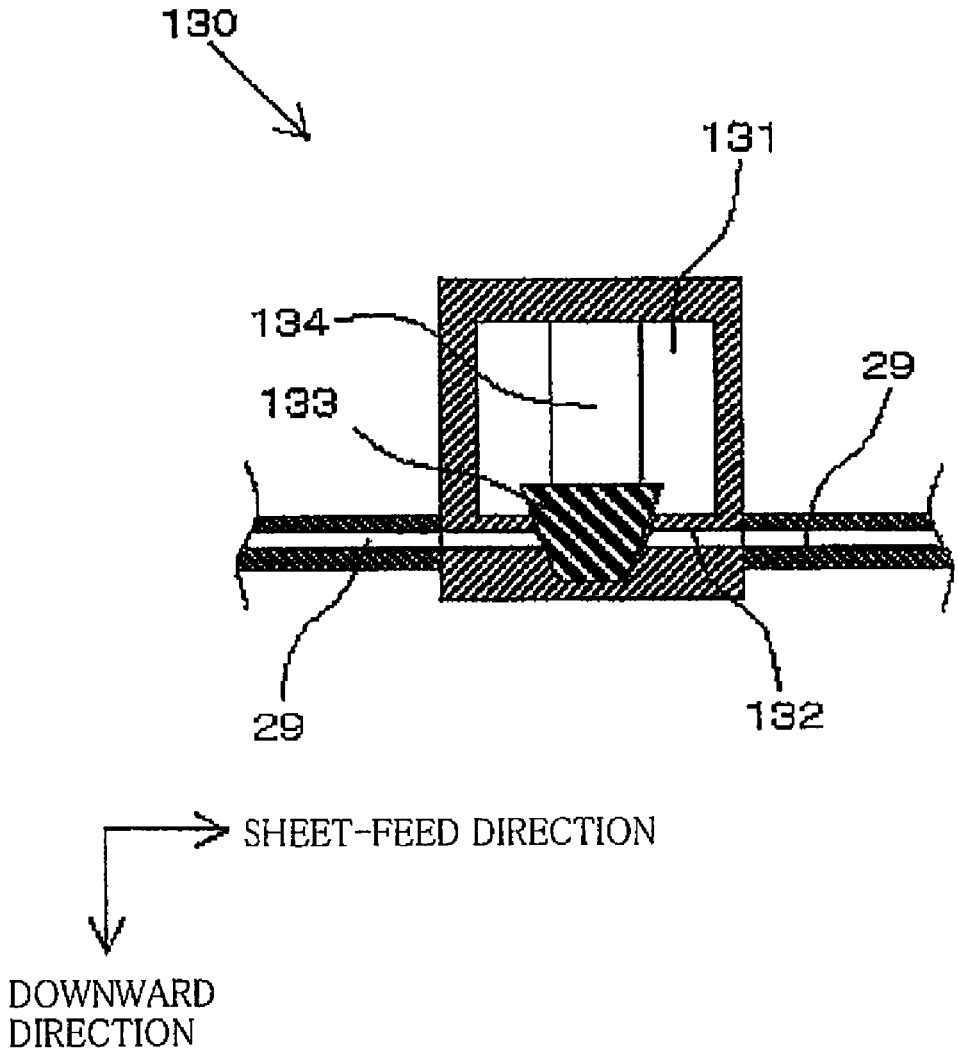
FIG. 15 is a cross-sectional view of a pressure control valve in the ink-jet printer of FIG. 13.

The pressure control valve 130 will be explained with reference to FIG. 15. As shown in FIG. 15, the pressure control valve 130 includes a casing 131 in which is formed an intra-valve passage 132 that communicates with the common gas passage 29. A valve member 133 having a generally truncated cone shape is disposed at a portion of the intra-valve passage 132. A biasing member 134 is connected to the valve member 133 for biasing the valve member 133 in a direction toward the intra-valve passage 132. According to the arrangement, the valve member 133 is pressed into the intra-valve passage 132, thereby causing a surface pressure therebetween. Owing to the surface pressure, the valve member 133 is closely fitted in the intra-valve passage 132, thus inhibiting a gas flow through the intra-valve passage 132.

In the supply mode, when the pump 60 operates to suck the gas in the sub tanks 8*a*-8*d*, a part of the intra-valve passage 132 located on one of opposite sides of the valve member 133 that is nearer to the pump 60 is subjected to a negative pressure. When the negative pressure increases exceeding the surface pressure generated between the valve member 133 and the intra-valve passage 132, the gas starts to flow along the surface of the valve member 133 contacting the intra-valve passage 132. In the ejection mode, when the pressure in the sub tanks 8*a*-8*d* decreases and the pressure in the common gas chamber becomes not higher than the threshold that is lower the atmospheric pressure, the gas starts to flow along the surface of the valve member 133 contacting the intra-valve passage 132.

According to the arrangement described above, the sub tanks 8*a*-8*d* are hermetically closed by the pressure control valve 130, and the gas is allowed to flow through the intra-valve passage 132 when the pressure in the common gas charmer becomes not higher than the threshold that is lower than the atmospheric pressure in the ejection mode, whereby the pressure in the common gas chamber can be controlled. In the arrangement, therefore, it is not necessary to separately provide the member for hermetically closing the sub tanks 8*a*-8*d* and the member for controlling the pressure in the common gas chamber, resulting in simplification of the structure of the box-like body 31.

In the illustrated embodiments, the tube pump is employed as the pump 60 for discharging and introducing the gas from and into the sub tanks 8*a*-8*d*. A centrifugal pump or the like may be used as the pump 60. Because the centrifugal pump is not configured to close a supply and exhaust opening thereof by itself, a suitable member for opening and closing the supply and exhaust opening needs to be provided where the centrifugal pump is employed.

In the illustrated first embodiment, the pressure control valve 50 for controlling the pressure in the common gas chamber may be replaced with a device which includes a sensor for detecting the pressure in the common gas chamber and a mechanism for automatically opening and closing the communication portion through which the common gas chamber and the exterior thereof communicate with each other. As such a mechanism, a plunger is employed, for instance.

In the illustrated embodiments, the head unit 9 is of a serial type for jetting the ink toward the recording sheet while moving in the width direction of the sheet. The present invention is applicable to an ink-jet printer having a head unit of a line type in which a plurality of nozzle rows extend over the entire width of the sheet.

In the illustrated embodiments, the head unit 9 employs the piezoelectric actuator configured to give a pressure to the ink for ejection. In place of the piezoelectric actuator, there may be employed a heater for heating and boiling the ink to give a pressure to the ink.

It is to be understood that the invention is not limited to the details of the illustrated embodiments and modified examples thereof, but may be embodied with various changes and modifications. For instance, the principle of the invention is applicable to various droplet-ejecting devices configured to eject liquids other than ink.

What is claimed is:

1. A liquid-droplet ejecting apparatus, comprising:

a plurality of liquid-droplet ejecting heads each including a nozzle from which liquid droplets are ejected;

a plurality of liquid storage chambers which respectively communicate with the plurality of liquid-droplet ejecting heads and which respectively store liquids to be supplied respectively to the plurality of liquid-droplet ejecting heads;

a plurality of liquid tanks which respectively accommodate the liquids to be supplied respectively to the plurality of liquid storage chambers;

a first communication-state changing device which is operable to place the plurality of liquid storage chamber and the plurality of liquid tanks in a mutually communicating state, in a supply mode in which the liquids respectively stored in the plurality of liquid tanks are respectively supplied to the plurality of liquid storage chambers, and which is operable to place the plurality of liquid storage chambers and the plurality of liquid tanks in a non-communicating state, in an ejection mode in which the liquids respectively stored in the plurality of liquid storage chambers are ejected from the respective liquid-droplet ejecting heads;

a common gas chamber which communicates commonly with the plurality of liquid storage chambers via respective gas-permeable membranes each of which is configured to be gas-permeable and liquid-impermeable;

a pump which introduces and discharges a gas into and from the common gas chamber; and a controller configured to control the first communication-state changing device to operate for placing the plurality of liquid storage chambers and the plurality of liquid tanks in the mutually communicating state and to control the pump to operate for discharging the gas from the common gas chamber while the mutually communicating state is maintained, in the supply mode, wherein the common gas chamber is configured to be hermetically closed with respect to an exterior thereof at least in the ejection mode, and wherein the liquid-droplet ejecting apparatus further comprises a pressure control device configured to control, at least in the ejection mode, a pressure in the common gas chamber such that, when the pressure becomes not higher than a threshold that is lower than an atmospheric pressure, the pressure becomes higher than the threshold, for preventing an adverse influence on liquid ejection that arises from a decrease in an internal pressure of the plurality of liquid storage chambers caused by liquid consumption, wherein the pressure control device includes a pressure control valve configured to open and close a communication portion that permits communication between the common gas chamber and the exterior thereof, such that the communication portion is closed when the pressure in the common gas chamber is higher than the threshold and such that the communication portion is temporarily opened when the pressure in the common gas chamber becomes not higher than the threshold so as to control the pressure to become higher than the threshold, wherein the liquid-droplet ejecting apparatus further comprises: a box-like body in which is formed a space that provides the plurality of liquid storage chambers and in which is provided an intra-body common chamber that constitutes at least a part of the common gas chamber, the intra-body common chamber commonly communicating with the plurality of liquid storage chambers via the respective gas-permeable membranes; and a second communication-state changing device which is operable to place, in the supply mode, the intra-body common chamber and the pump in a mutually communicating state and which is operable to place, in the ejection mode, the intra-body common chamber and the pump in a non-communicating state, wherein the controller is configured to control the first communication-state changing device to operate for placing the plurality of liquid storage chambers and the plurality of liquid tanks in the mutually communicating state while controlling the second communication-state changing device to operate for placing the intra-body common chamber and the pump in the mutually communicating state, in the supply mode, and is configured to control the first communication-state changing device to operate for placing the plurality of liquid storage chambers and the plurality of liquid tanks in the non-communicating state while controlling the second communication-state changing device to operate for placing the intra-body common chamber and the pump in the non-communicating state, in the ejection mode, wherein the second communication-state changing device includes a first joint portion formed in the box-like body and a second joint portion which is provided so as to communicate with the pump and which is to be connected to the first joint portion, wherein the first joint portion includes: a valve member which is displaceable in an inside of the box-like body between an open position at which the communication portion is opened and a closed position at which the communication portion is closed; and a biasing member which biases the valve member such that the valve member is located at the closed position, wherein the second joint portion includes a valve opening member which enters the communication portion when the second joint portion is connected to the first joint portion for pushing the valve member against a biasing force of the biasing member, thereby opening the communication portion, and wherein the biasing force of the biasing member is set such that the valve member is moved to the open position due to a difference between the atmospheric pressure and the pressure in the common gas chamber when the pressure in the common gas chamber becomes not higher than the threshold, whereby the first joint portion functions as the pressure control valve.

2. The liquid-droplet ejecting apparatus according to claim 1, further comprising: a carriage on which are mounted the plurality of liquid-droplet ejecting heads and the box-like body; and a carriage moving device configured to reciprocatingly move the carriage, wherein the controller is configured to control the plurality of liquid-droplet ejecting heads to respectively eject the liquids while controlling the carriage moving device such that the carriage is reciprocatingly moved within a prescribed range, in the ejection mode, and is configured to control the carriage moving device such that the carriage is moved to a liquid-supply position distant from the prescribed range, in the supply mode, and wherein, when the carriage is moved to the liquid-supply position, the plurality of liquid storage chambers and the plurality of liquid tanks are disposed so as to be placed in the mutually communicating state while the intra-body common chamber and the pump are disposed so as to be placed in the mutually communicating state when the carriage is moved to the liquid-supply position.

3. The liquid-droplet ejecting apparatus according to claim 1, wherein, in the supply mode, the controller controls the first communication-state changing device to place the plurality of liquid storage chambers and the plurality of liquid tanks in the mutually communicating state, controls the pump to operate for a prescribed time period for introducing the gas into the common gas chamber while the mutually communicating state is maintained, and subsequently controls the pump to operate for discharging the gas from the common gas chamber while the mutually communicating state is maintained.

* * * * *